US005830618A

United States Patent [19]

Yamaguchi

[11] Patent Number: 5,830,618

[45] **Date of Patent: *Nov. 3, 1998**

[54] SILVER HALIDE PHOTOGRAPHIC MATERIAL

[75] Inventor: Tetsuo Yamaguchi, Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 692,609

[22] Filed: Aug. 6, 1996

Related U.S. Application Data

[63] Continuation of Ser. No. 883,462, May 15, 1992, abandoned.

[30] Foreign Application Priority Data

May 17, 1991 [JP] Japan ..... 3-140686

[51] Int. Cl.[6] ..... G03C 1/06

[52] U.S. Cl. ..... 430/264; 430/250; 430/440; 430/480; 430/482; 430/544; 430/614; 430/957

[58] Field of Search ..... 430/614, 264, 430/480, 483, 440, 223, 544, 957, 250

[56] References Cited

U.S. PATENT DOCUMENTS

| | | | |
|---|---|---|---|
| 3,960,568 | 6/1976 | Sueyoshi et al. | 430/630 |
| 4,680,257 | 7/1987 | Sato et al. | 430/614 |
| 4,933,268 | 6/1990 | Ohno et al. | 430/522 |
| 5,134,055 | 7/1992 | Okamura et al. | 430/264 |

FOREIGN PATENT DOCUMENTS 63-75737 4/1988 Japan .

*Primary Examiner*—Thorl Chea

*Attorney, Agent, or Firm*—Sughrue, Mion, Zinn, Macpeak & Seas, PLLC

[57] ABSTRACT

A silver halide photographic material is provided which comprises a support having thereon at least one light-sensitive silver halide emulsion layer wherein said light-sensitive layer or another hydrophilic colloidal layer provided on the support contains a compound represented by formula (I) and a hydrazine derivative represented by formula (II):

(I)

wherein $R^1$ and $R^2$ may be the same or different and each represents a hydroxyl, hydroxylamino, amino, alkylamino, arylamino, aralkylamino, alkoxy, phenoxy, alkyl, aryl, alkylthio, or phenylthio group, (II)

wherein $R^3$ represents an aliphatic or aromatic group; $R^4$ represents a hydrogen atom, or an alkyl, aryl, alkoxy, aryloxy, amino or hydrazino group; $G^1$ represents a —CO—, —$SO_2$—, —SO—, —P(O)$R^4$, —CO—CO—, thiocarbonyl or iminomethylene group; and $A^1$ and $A^2$ each represents a hydrogen atom, or one of $A^1$ and $A^2$ represents a hydrogen atom and the other represents a substituted or unsubstituted alkylsulfonyl, arylsulfonyl or acyl group. In a preferred embodiment, the silver halide photographic material contains a redox compound which undergoes oxidation to release a development inhibitor.

10 Claims, No Drawings

SILVER HALIDE PHOTOGRAPHIC MATERIAL

This is a Continuation of application Ser. No. 07/883,462 filed May 15, 1992, now abandoned.

FIELD OF THE INVENTION

The present invention relates to a silver halide photographic material, more particularly to a negative type photographic material, for use in the field of photomechanical processing. This material can be processed with a highly stable processing solution to provide rapid formation of an ultrahigh contrast image.

BACKGROUND OF THE INVENTION

In photomechanical processing, an image formation system which exhibits an ultrahigh contrast, particularly gamma of 10 or more, is required to optimize reproduction of continuous tone with dot images, or reproduction of line images.

Hitherto, a lithographic developer has been used in these applications. The lithographic developer contains only hydroquinone as a developing agent. To maintain its infectious developing properties, lithographic developers contain a sulfite as a preservative, in the form of an adduct of formaldehyde, to keep the concentration of sulfurous ions extremely low, normally 0.1 mol/l or less. Therefore, the lithographic developer has the serious disadvantage that it is extremely susceptible to air oxidation and thus cannot be stored for more than 3 days.

To form a high contrast image, a process which utilizes a hydrazine compound may be employed, as disclosed in U.S. Pat. Nos. 4,224,401, 4,168,977, 4,166,742, 4,311,781, 4,272,606, 4,221,857, 4,243,739, and 4,269,929. In accordance with this process, ultrahigh contrast and high sensitivity can be obtained, and a high concentration of sulfite may be added to the developer. Thus, the stability of the developer and resistance to air oxidation is drastically improved as compared with the standard lithographic developer.

Examples of a system using hydrazine and containing a redox compound which undergoes oxidation to release a development inhibitor are disclosed in JP-A-61-213847 and 64-72140 (the term "JP-A" as used herein means an "unexamined published Japanese patent application").

In the field of photomechanical processing, and other fields, a silver halide photographic material may be prepared by coating a coating solution containing a silver halide emulsion on a support. This coating solution has a silver halide emulsion dissolved therein, and also contains additives to provide photographic and physical properties necessary for the light-sensitive material. However, when aged in the form of a solution containing these additives, this coating solution is subject to fluctuations in sensitivity.

It was found that if an emulsion containing a halogen composition with a high silver chloride content is used, the sensitivity shows great fluctuation with time due to changes in dissolution of the silver chloride compounds, which impairs the preparation of a stable light-sensitive material.

For various reasons, a sulfur-sensitized silver chlorobromide emulsion has widely been used in a system containing hydrazine, as described in JP-A-53-20921, 60-83028, 60-112034, 61-249161, 61-47943, 62-235947, 63-103232, and 1-120549, and Japanese Patent Application Nos. 1-109981 and 1-113093. However, the system encounters an undesired increase in sensitivity with the passage of time.

In the field of photomechanical processing, practitioners require photographic light-sensitive materials exhibiting excellent original reproducibility, stable processing solutions and simplified replenishment methods to cope with the diversity and complexity of printed matter.

Line originals subjected to the process of picture taking normally have photo-composed letters, handwritten letters, illustrations, dot photographs and the like thereon. Thus, line originals are normally formed of a mixture of images having different densities and line width. Therefore, plate-making cameras, photographic light-sensitive materials or image formation methods which can give an excellent reproduction of these originals are required. On the other hand, enlargement or reduction of dot photographs is widely conducted to make plates for catalogues or large-sized posters. In the dot enlargement process, the number of lines per inch is reduced, giving an unsharp picture. In the dot reduction process, the number of lines per inch becomes greater than that of the original, giving a fine picture. Accordingly, an image formation method which provides a wider latitude to maintain excellent reproducibility of dot gradation is required.

Halogen lamps or xenon lamps have been employed as light sources for plate-making cameras. To be sufficiently sensitive to these light sources, light-sensitive materials are normally subjected to orthochromatic sensitization. However, it has been found that orthochromatically sensitized photographic light-sensitive materials are more susceptible to effects of chromatic aberration of lenses, which can deteriorate the picture quality, particularly if a xenon lamp is used.

The above image formation system provides excellent dot sharpness, processing stability and rapidity, and original reproducibility. To cope with the recent diversification of printed matter, a system has been desired which provides greater stability and more original reproducibility.

SUMMARY OF THE INVENTION

It is therefore a first object of the present invention to provide a silver halide photographic material having high sensitivity and high contrast (e.g., $\gamma$=10 or more), which can be prepared with a small fluctuation in sensitivity and qualities, and which exhibits little increase in sensitivity even after long storage.

It is a second object of the present invention to provide a silver halide photographic material having high sensitivity, high contrast and an excellent line image quality which exhibits small fluctuation during preparation of the photographic material and after long storage thereof.

These and other objects of the present invention will become more apparent from the following detailed description and examples.

The first object of the present invention is accomplished with a silver halide photographic material which comprises a support having thereon at least one light-sensitive silver halide emulsion layer, wherein said light-sensitive layer or another hydrophilic colloidal layer provided on the support contains a compound represented by formula (I) and a hydrazine derivative represented by formula (II):

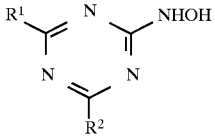

(I)

wherein $R^1$ and $R^2$ may be the same or different and each represents a hydroxyl, hydroxylamino, amino, alkylamino, arylamino, aralkylamino, alkoxy, phenoxy, alkyl, aryl, alkylthio, or phenylthio group;

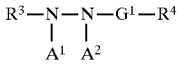

(II)

wherein $R^3$ represents an aliphatic group or aromatic group; $R^4$ represents a hydrogen atom, or an alkyl, aryl, alkoxy, aryloxy, amino or hydrazino group; $G^1$ represents a —CO—, —$SO_2$—, —SO—, —P(O)$R^4$—, —CO—CO—, thiocarbonyl or iminomethylene group; and $A^1$ and $A^2$ each represents a hydrogen atom, or one of $A^1$ and $A^2$ represents a hydrogen atom and the other represents a substituted or unsubstituted alkylsulfonyl, arylsulfonyl or acyl group.

The second object of the present invention can be accomplished with such a silver halide photographic material which comprises in the emulsion layer or another hydrophilic colloidal layer a redox compound which undergoes oxidation to release a development inhibitor.

DETAILED DESCRIPTION OF THE INVENTION

In formula (I), $R^1$ and $R^2$ may be the same or different and each represents a hydroxyl group, a hydroxylamino group, an amino group, an alkylamino group (preferably a $C_{1-5}$ alkyl mono- or di-substituted amino group), an arylamino group preferably having 6 to 10 carbon atoms, an aralkylamino group preferably having 7 to 11 carbon atoms, an alkoxy group preferably having 1 to 5 carbon atoms, a phenoxy group, an alkyl group preferably having 1 to 5 carbon atoms, an aryl group preferably having 6 to 10 carbon atoms, an alkylthio group preferably having 1 to 5 carbon atoms, or a phenylthio group.

The alkyl portion of these groups may contain substituents such as a hydroxyl group, an alkoxy group (preferably $C_{1-4}$, particularly $C_{1-2}$ alkoxy group), an amino group, and an alkylamino group (preferably $C_{1-4}$, particularly $C_{1-2}$ alkyl mono- or di-substituted amino group).

In the groups represented by $R^1$ and $R^2$, the aryl or phenyl portion may contain substituents such as a hydroxyl group, an amino group, an alkylamino group (preferably $C_{1-4}$, particularly $C_{1-2}$ alkyl mono- or di-substituted amino group), an alkyl group (preferably $C_{1-4}$, particularly $C_{1-2}$ alkyl group), and an alkoxy group (preferably $C_{1-4}$, particularly $C_{1-2}$ alkoxy group).

Examples of the use of the compound represented by formula (I) are described in JP-A-63-75737.

Examples of compounds represented by formula (I) which can be preferably used in the present invention will be set forth below.

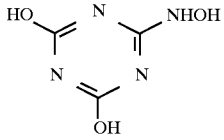

I-1

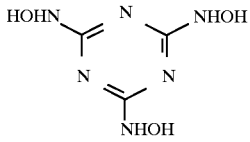

I-2

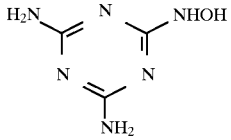

I-3

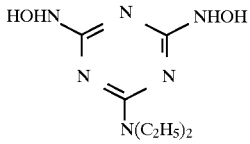

I-4

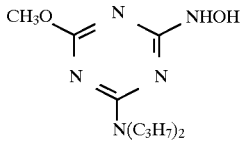

I-5

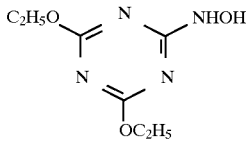

I-6

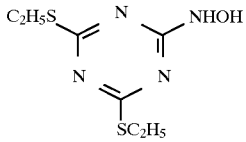

I-7

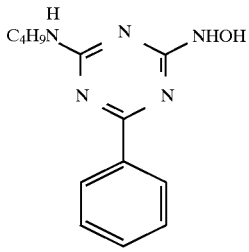

I-8

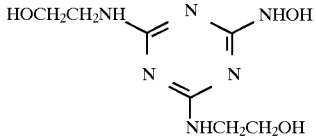

I-9

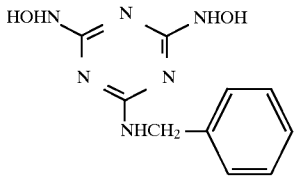

I-10

-continued

I-11

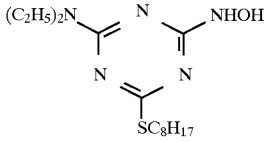

I-12

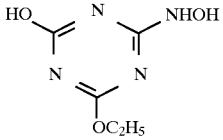

I-13

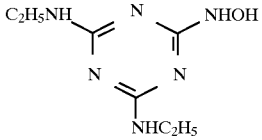

I-14

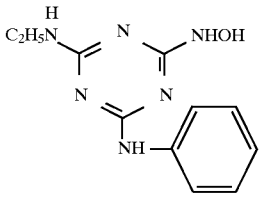

I-15

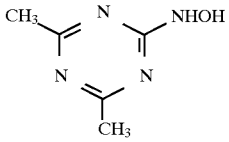

I-16

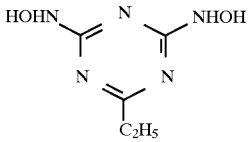

I-17

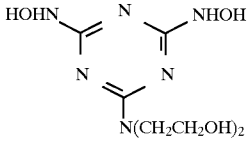

I-18

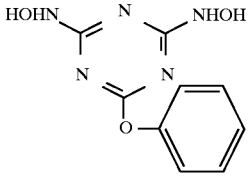

I-19

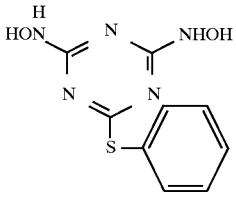

I-20

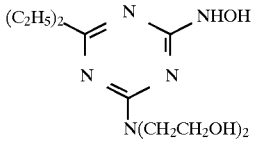

-continued

I-21

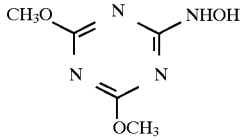

The synthesis of these compounds can be accomplished by any suitable method as disclosed in *Journal of the Organic Chemistry*, vol. 27, page 4,054 (1962), *Journal of the American Chemical Society*, vol. 73, page 2,981 (1951), and JP-B-49-10692 (the term "JP-B" as used herein means an "examined Japanese patent publication").

These compounds of formula (I) may be incorporated in a hydrophilic colloidal solution for use in the preparation of a photographic emulsion layer or another constituent layer (e.g., overlayer, filter layer, interlayer, preferably a layer adjacent to the emulsion layer) in the form of an aqueous solution, a hydrochloric acid aqueous solution or methanol solution. In the present invention, these compounds are particularly preferably incorporated in the photographic emulsion layer. The time at which these compounds are incorporated in these layers is not specifically limited, but they are preferably added between the completion of the second ripening and shortly before the coating if they are incorporated in the photographic emulsion.

The amount of these compounds of formula (I) to be incorporated is normally from 0.01 to 10 g, particularly 0.1 to 1 g, per mol of silver in the silver halide photographic material.

The hydrazine derivative to be used in the present invention is represented by formula (II):

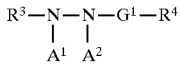

(II)

wherein $R^3$ represents an aliphatic group or an aromatic group; $R^4$ represents a hydrogen atom, an alkyl group, an alkoxy group, an aryloxy group, an amino group or a hydrazino group; $G^1$ represents a —CO— group, a —$SO_2$— group, a —SO— group, a —P(O)($R^4$)— group, a —CO—CO— group, a thiocarbonyl group or an iminomethylene group; and $A^1$ and $A^2$ each represents a hydrogen atom, or one of $A^1$ and $A^2$ represents a hydrogen atom and the other represents a substituted or unsubstituted alkylsulfonyl group, a substituted or unsubstituted arylsulfonyl group or a substituted or unsubstituted acyl group.

In formula (II), the aliphatic group represented by $R^3$ is preferably a $C_{1-30}$, more preferably a $C_{1-20}$ straight-chain, branched or cyclic alkyl group. This alkyl group may contain substituents.

In formula (II), the aromatic group represented by $R^3$ is a monocyclic or bicyclic aryl group or unsaturated heterocyclic group. The unsaturated heterocyclic group may be condensed with an aryl group.

$R^3$ in formula (II) is preferably an aryl group, particularly an aryl group containing benzene rings.

The aliphatic or aromatic group represented by $R^3$ may be substituted. Typical examples of such substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkylsulfonyl group, an arylsulfonyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric amido group, a diacylamino group, an imido group, and a $R^4$—NH—CO—N($R^4$)—CO— group. Preferred among these groups are, an alkyl group (preferably $C_{1-20}$ alkyl group), an aralkyl group (preferably $C_{7-30}$ aralkyl group), an alkoxy group (preferably $C_{1-20}$ alkoxy group), a substituted amino group (preferably $C_{1-20}$ alkyl-substituted amino group), an acylamino group (preferably $C_{2-30}$ acylamino group), a sulfonamido group (preferably $C_{1-30}$ sulfonamido group), a ureido group (preferably $C_{1-30}$ ureido group), and a phosphoric amido group (preferably $C_{1-30}$ phosphoric amido group).

In formula (II), the alkyl group represented by $R^4$ is preferably a $C_{1-4}$ alkyl group. The aryl group represented by $R^4$ is preferably a monocyclic or bicyclic aryl group (e.g., one containing benzene rings).

If $G^1$ is a —CO— group, preferred among the groups represented by $R^4$ are a hydrogen atom, an alkyl group (e.g., methyl, trifluoromethyl, 3-hydroxypropyl, 3-methanesulfonamidepropyl, phenylsulfonylmethyl), an aralkyl group (e.g., o-hydroxybenzyl), and an aryl group (e.g., phenyl, 3,5-dichlorophenyl, o-methanesulfonamidophenyl, 4-methanesulfonylphenyl, 2-hydroxymethylphenyl). Particularly preferred among these groups is a hydrogen atom.

$R^4$ may be substituted, and may contain those substituents described as being substituents on $R^3$.

In formula (II), $G_1$ is most preferably a —CO— group.

Furthermore, $R^4$ may be a group which causes the $G^1$—$R^4$ portion to be separated from the rest of the molecule to effect a cyclization reaction that produces a cyclic structure containing atoms contained in the —$G^1$—$R^4$ portion. Examples of such a group include those described in JP-A-63-29751.

$A^1$ and $A^2$ each is most preferably a hydrogen atom.

In formula (II), $R^3$ or $R^4$ may contain a ballast group or polymer commonly incorporated in immobile photographic additives, such as a coupler. Such a ballast group is a group containing 8 or more carbon atoms with relatively inert photographic properties. Such a group can be selected from an alkyl group, an alkoxy group, a phenyl group, an alkylphenyl group, a phenoxy group, an alkylphenoxy group, etc. Examples of the above mentioned polymer include those disclosed in JP-A-1-100530.

$R^3$ or $R^4$ may contain a group which intensifies the adsorption on the surface of silver halide grains. Examples of such an adsorption group include a thiourea group, a heterocyclic thioamido group, a mercaptoheterocyclic group, and a triazole group as disclosed in U.S. Pat. Nos. 4,385,108, and 4,459,347, JP-A-59-195233, 59-200231, 59-201045, 59-201046, 59-201047, 59-201048, 59-201049, 61-170733, 61-270744, 62-948, 63-234244, 63-234245, and 63-234246.

Specific examples of the compounds represented by formula (II) will be set forth below, but the present invention should not be construed as being limited thereto.

II-1

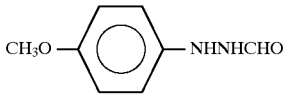

II-2

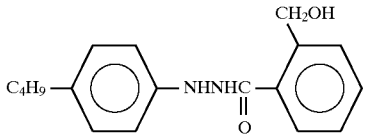

II-3

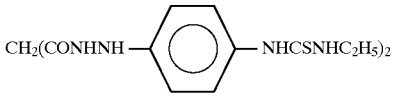

II-4

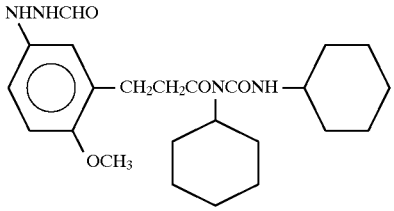

II-5

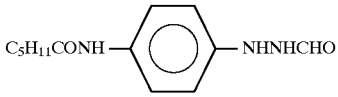

II-6

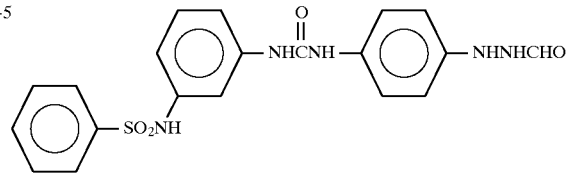

II-7

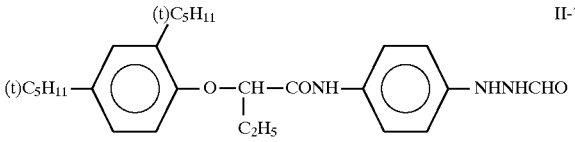

II-8

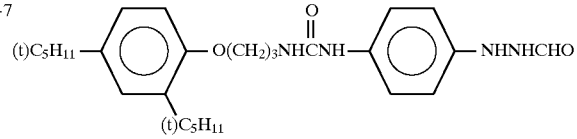

II-9

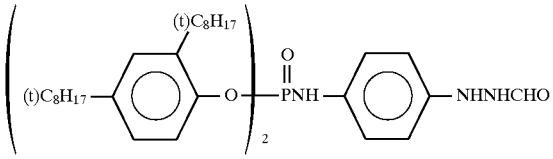

II-10

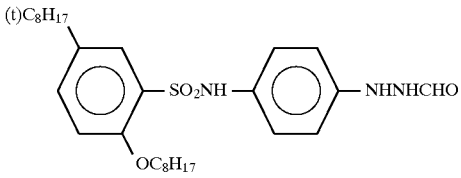

-continued
II-11
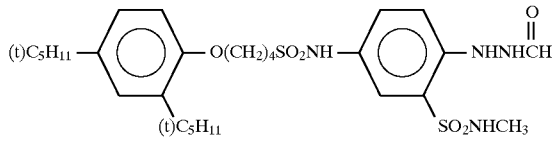
II-12
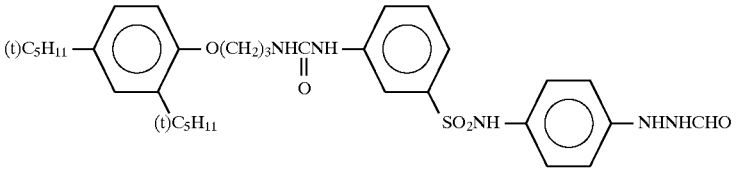
II-13
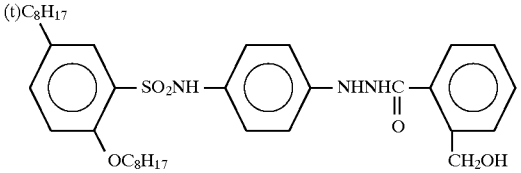
II-14
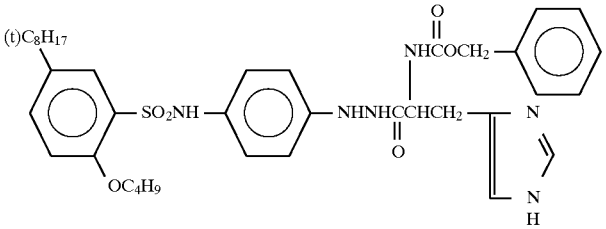
II-15
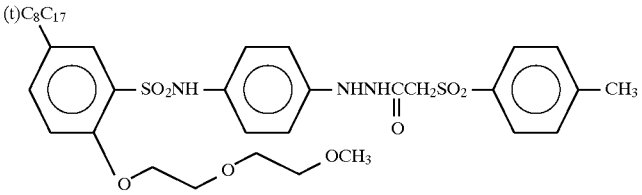
II-16
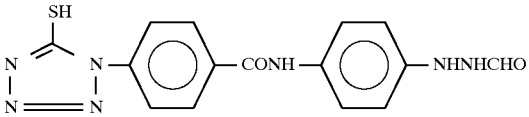
II-17
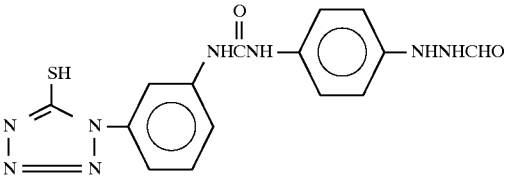
II-18
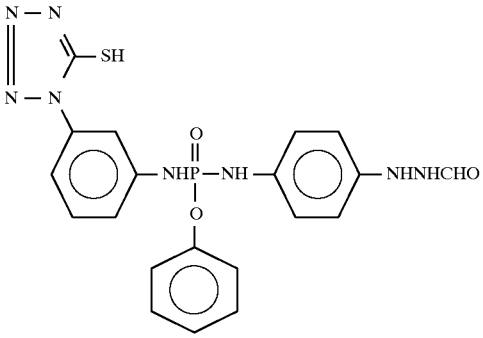
II-19
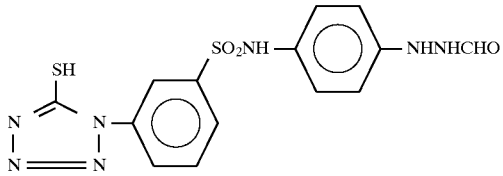

-continued

II-20

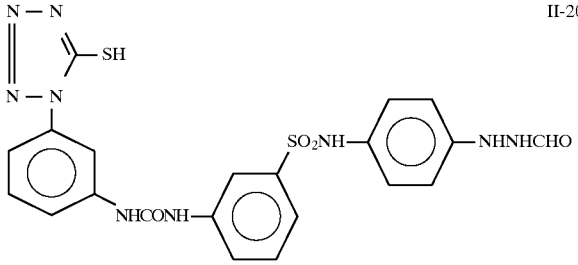

II-21

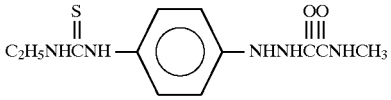

II-22

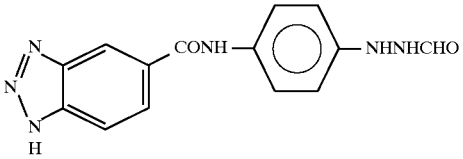

II-23

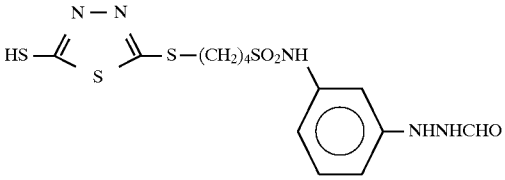

II-24

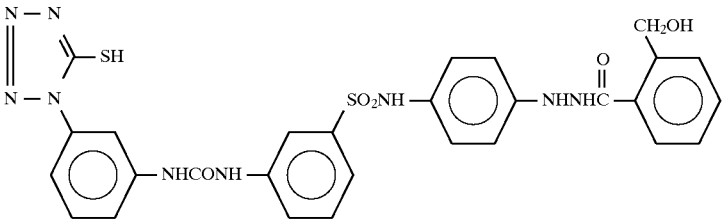

II-25

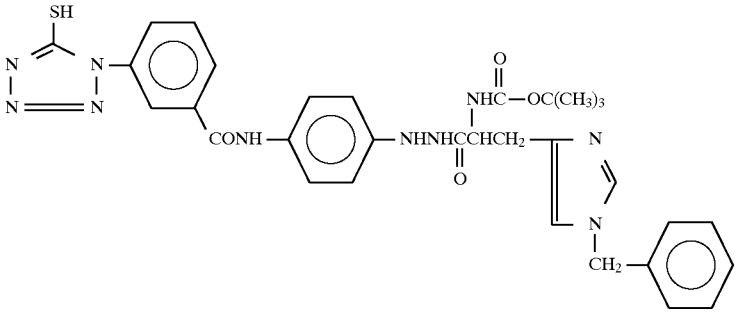

II-26

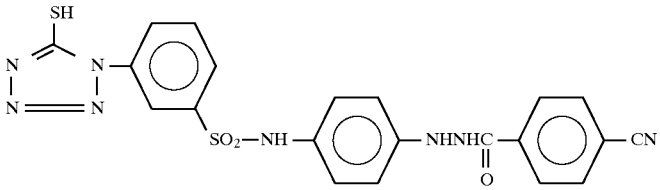

Other examples of hydrazine derivatives which can be used in the present invention include those described in *Research Disclosure*, Item 23516 (November 1983, page 346), references cited therein, U.S. Pat. Nos. 4,080,207, 4,269,929, 4,276,364, 4,278,748, 4,385,108, 4,459,347, 4,560,638, 4,478,928, and 4,686,167, British Patent 2,011, 391B, EP 217,310, JP-A-60-179734, 62-270948, 63-29751, 61-170733, 61-270744, 62-948, 62-178246, 63-32538, 63-104047, 63-121838, 63-129337, 63-223744, 63-234244, 63-234245, 63-234246, 63-294552, 63-306438, 1-100530, 1-105941, 1-105943, 64-10233, 1-90439, 1-276128, 1-280747, 1-283548, 1-283549, 1-285940, 2-2541, 2-139538, and 2-77057, and Japanese Patent Application Nos. 1-18377, 1-18378, 1-18379, 1-15755, 1-16814, 1-40792, 1-42615, 1-42616, 1-123693, and 1-126284.

The hydrazine derivative is not necessarily incorporated in the layer containing the compound of formula (I) and may be added to the photographic emulsion layer and/or another constituent layer. In the present invention, the hydrazine derivative is preferably incorporated in the emulsion layer or a layer adjacent thereto and particularly preferably in the emulsion layer.

The amount of the hydrazine derivative to be incorporated is preferably from $1\times10^{-6}$ to $5\times10^{-2}$ mol, particularly $1\times10^{-5}$ to $2\times10^{-2}$ mol, per mol of silver halide in the present silver halide photographic material.

The redox compound of the present invention which can undergo oxidation to release a development inhibitor will now be described in detail.

Preferred examples of the redox group contained in the redox compound include a hydroquinone group, a catechol group, a naphthohydroquinone group, an aminophenol group, a pyrazolidone group, a hydrazine group, a hydroxylamine group, and a reductone group. Most preferred among these redox groups are hydrazine groups. The redox compound of the present invention is preferably a compound which comprises a development inhibitor at least a part of which is eluted in the developer to react with components thereof to become a less inhibiting compound.

The hydrazine compounds to be used as redox compounds which can undergo oxidation to release a development inhibitor are represented by formulae (R-1), (R-2) and (R-3), particularly preferably formula (R-1).

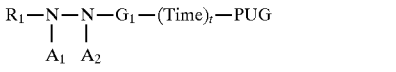

(R-1)

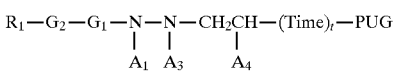

(R-2)

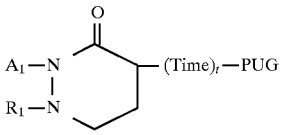

(R-3)

In these formulae, $R_1$ represents an aliphatic group or an aromatic group. $G_1$ represents a —CO— group, a —CO—CO— group, a —CS— group, a —C($NG_2R_2$)— group, a —SO— group, a —$SO_2$— group or a —PO($G_2R_2$)— group. $G_2$ represents a mere bond, —O—, —S— or —$NR_2$—, in which $R_2$ represents a hydrogen atom or $R_1$.

$A_1$ and $A_2$ each represents a hydrogen atom or an alkylsulfonyl group, an arylsulfonyl group or an acyl group which may be substituted. In formula (R-1), at least one of $A_1$ and $A_2$ represents a hydrogen atom. $A_3$ has the same meaning as $A_1$ or represents —$CH_2$—CH($A_4$)-(Time)$_t$-PUG.

$A_4$ represents a nitro group, a cyano group, a carboxyl group, a sulfo group or —$G_1$—$G_2$—$R_1$.

Time represents a divalent linking group. The suffix t represents 0 or 1. PUG represents a development inhibitor.

In formulae (R-1), (R-2) and (R-3), the aliphatic group represented by $R_1$ is preferably a $C_{1-30}$, particularly $C_{1-20}$ straight-chain, branched or cyclic alkyl group which may contain substituents.

In formulae (R-1), (R-2) and (R-3), the aromatic group represented by $R_1$ is a monocyclic or bicyclic aryl group or an unsaturated heterocyclic group. The unsaturated heterocyclic group may be condensed with an aryl group to form a heteroaryl group.

Examples of the aromatic group represented by $R_1$ include a benzene ring, naphthalene ring, pyridine ring, quinoline ring, and isoquinoline ring. Particularly preferred are those containing a benzene ring.

$R_1$ is particularly preferably an aryl group.

The aryl group or the unsaturated heterocyclic group may be substituted. Typical examples of such substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, and phosphoric acid amido group. Preferred among these substituents are a straight-chain, branched or cyclic alkyl group (preferably $C_{1-20}$ alkyl group), an aralkyl group (preferably $C_{7-30}$ aralkyl group), an alkoxy group (preferably $C_{1-30}$ alkoxy group), a substituted amino group (preferably $C_{1-30}$ alkyl-substituted amino group), an acylamino group (preferably $C_{2-40}$ acylamino group), a sulfonamido group (preferably $C_{1-40}$ sulfonamido group), a ureido group (preferably $C_{1-40}$ ureido group), and a phosphoric acid amido group (preferably $C_{1-40}$ phosphoric acid amido group).

In formulae (R-1), (R-2) and (R-3), $G_1$ is preferably a —CO— group or a —$SO_2$— group, most preferably a —CO— group.

$A_1$ and $A_2$ each is preferably a hydrogen atom. $A_3$ is preferably a hydrogen atom or —$CH_2$—CH($A_4$)-(Time)$_t$-PUG.

Time represents a divalent linking group which may serve to adjust timing.

The divalent linking group represented by Time represents a group which causes PUG to be released from Time-PUG, which has been released from an oxidation product of a redox nucleus through a reaction in one or more stages.

Examples of the divalent linking group represented by Time include linking groups which undergo an intramolecular ring closure reaction of a p-nitrophenoxy derivative to release PUG as described in U.S. Pat. No. 4,248,962 (JP-A-54-145135), linking groups which undergo an intramolecular ring closure reaction after a ring cleavage to release PUG as described in U.S. Pat. Nos. 4,310,612 (JP-A-55-53330) and 4,358,525, linking groups which undergo an intramolecular ring closure reaction of a carboxyl group in a succinic monoester or analogous compound thereof to release PUG while producing an acid anhydride as described in U.S. Pat. Nos. 4,330,617, 4,446,216 and 4,483,919, and JP-A-59-121328, linking groups which undergo an electron migration via a double bond by which an aryloxy group or a heterocyclic oxy group is conjugated to release PUG while producing quinomonoethane or analogous compounds thereof as described in U.S. Pat. Nos. 4,409,323, 4,421,845, and 4,416,977 (JP-A-57-135944), *Research Disclosure* No. 21,228 (December 1981), and JP-A-58-209736 and 58-209738, linking groups which undergo an electron migration in a portion having a nitrogen-containing heterocyclic enamine structure to release PUG from the γ-position of enamine as described in U.S. Pat. No. 4,420,554 (JP-A-57-136640), and JP-A-57-135945, 57-188035, 58-98728, and 58-209737, linking groups which undergo an electron migration to a carbonyl group conjugated with a nitrogen atom in a nitrogen-containing heterocyclic group to produce an oxy group which undergoes an intramolecular ring closure reaction to release PUG as described in JP-A-57-56837, linking groups which release PUG with the formation of an aldehyde as described in U.S. Pat. No. 4,146,396 (JP-A-52-90932), and JP-A-59-93442, 59-75475, 60-249148, and 60-249149, linking groups which release PUG with the decarboxylation of an carboxyl group as described in JP-A-51-146828, 57-179842 and 59-104641, linking groups having a —O—COOCRaRb-PUG (in which Ra and Rb each represents a monovalent group) structure which release PUG with the formation of an aldehyde following decarboxylation, linking groups which release PUG with the formation of isocyanate as described in JP-A-60-7429, and linking groups which a undergo coupling reaction with an oxidation product of a color developing agent to release PUG as described in U.S. Pat. No. 4,438,193.

Specific examples of the divalent linking group represented by Time are further described in JP-A-61-236549, and 1-269936, and Japanese Patent Application No. 2-93487.

PUG represents a group which exhibits an effect of inhibiting development in the form of (Time)$_t$-PUG or PUG. PUG is preferably a development inhibitor which can react with components of a developer to become a less inhibiting compound when eluted in the developer.

The development inhibitor represented by PUG or (Time)$_t$PUG is a known development inhibitor containing a hetero atom via which a bond is made. Examples of such a known development inhibitor are described in C. E. K. Mees & T. H. James, *The Theory of Photographic Process,* 3rd ed., 1967, Macmillan, p 344–346.

The development inhibitor represented by PUG may be substituted. Examples of such substituents include those substituents described as being substituents on $R_1$. These substituents may be further substituted.

Preferred examples of such substituents include a nitro group, a sulfo group, a carboxyl group, a sulfamoyl group, a phosphono group, a phosphinic group, and a sulfonamido group.

In formulae (R-1), (R-2) and (R-3), $R_1$ or -(Time)$_t$-PUG may contain a ballast group commonly incorporated in immobile photographic additives such as coupler or a group which accelerates the adsorption of the compound represented by formula (R-1), (R-2) or (R-3) on silver halide grains.

The ballast group is an organic group which provides the compound represented by formula (R-1), (R-2) or (R-3) with a large enough molecular weight to prevent the compound from diffusing into other layers or processing solution. The ballast group comprises of a combination of an alkyl group, an aryl group, a heterocyclic group, an ether group, a thioether group, an amido group, a ureido group, a urethane group, a sulfonamido group, etc. A ballast group containing substituted benzene rings is preferred, particularly a ballast group containing branched alkyl-substituted benzene rings.

Specific examples of the group which accelerates the adsorption on silver halide grains include cyclic thioamido groups (such as, 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, and 1,3-imidazoline-2-thione), chain thioamido groups, aliphatic mercapto groups, aromatic mercapto groups, heterocyclic groups (if the atom adjacent to the carbon atom to which —SH group is bonded is a nitrogen atom, the heterocyclic mercapto groups have the same meaning as the cyclic thioamido groups which are tautomeric therewith; specific examples of these heterocyclic mercapto groups include those mentioned above), groups containing a disulfide bond, nitrogen-containing heterocyclic groups containing 5 or 6 members consisting of a combination of nitrogen, oxygen, sulfur and carbon, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, and azaindene, and heterocyclic quaternary salts such as benzimidazolinium.

These adsorption accelerating groups may be further substituted.

Examples of such substituents include those substituents described above as being substituents on $R_1$.

Specific examples of the redox compound which can be used in the present invention will be set forth below, but the present invention should not be construed as being limited thereto.

III-1
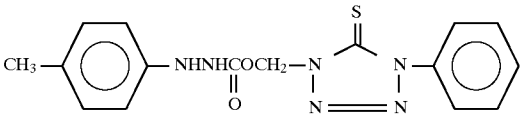
III-2
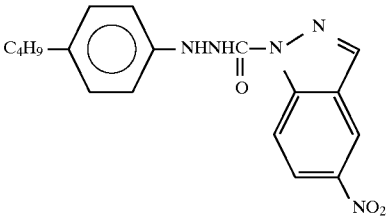
III-3
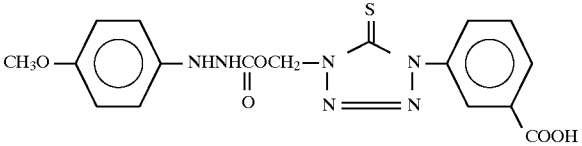
III-4
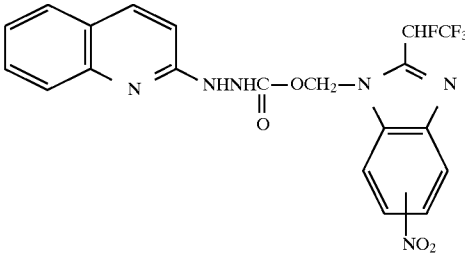
III-5
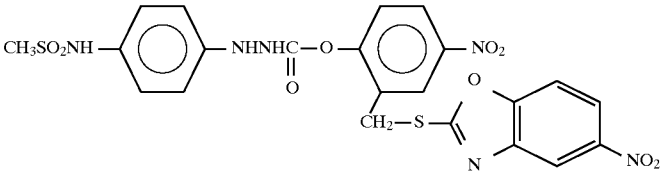

-continued
III-6
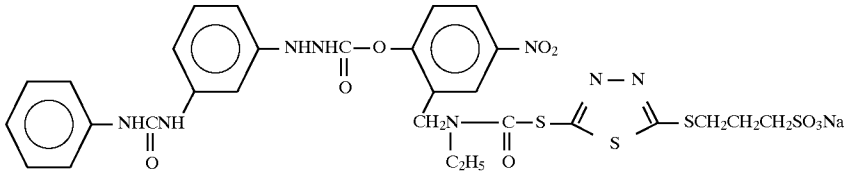
III-7
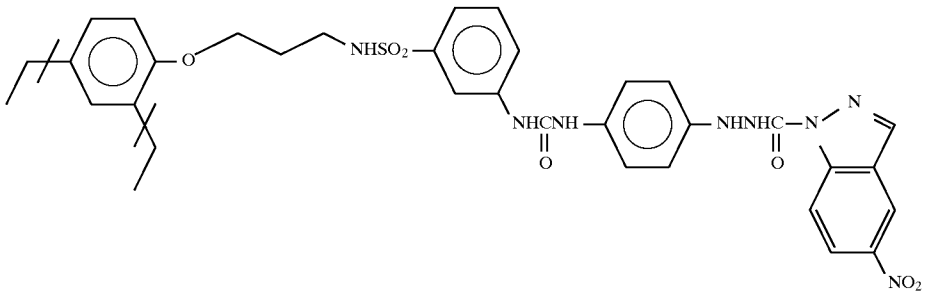
III-8
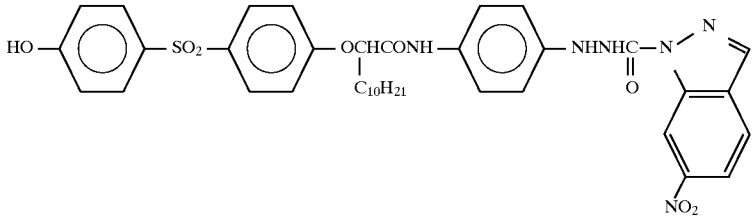
III-9
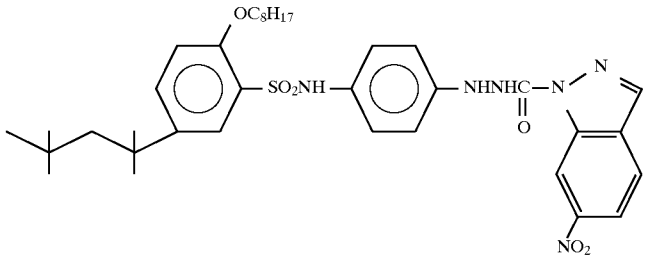

-continued
III-10
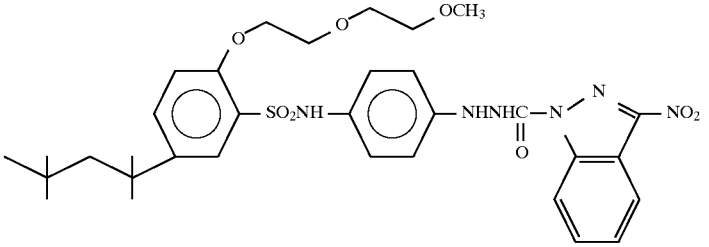
III-11
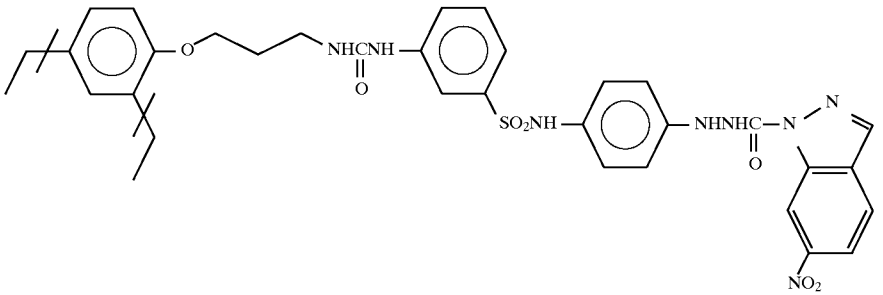
III-12
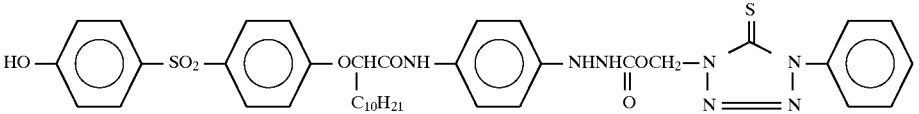
III-13
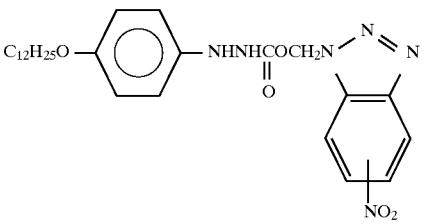

-continued
III-14
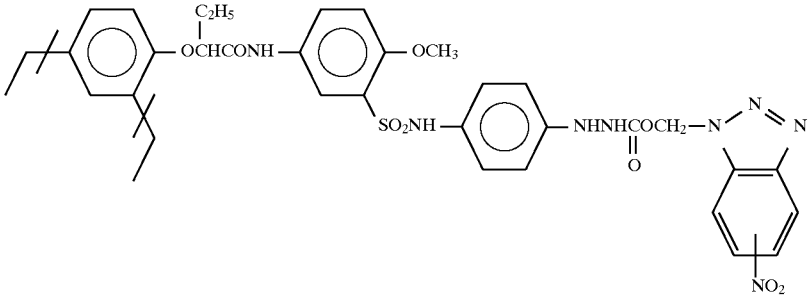
III-15
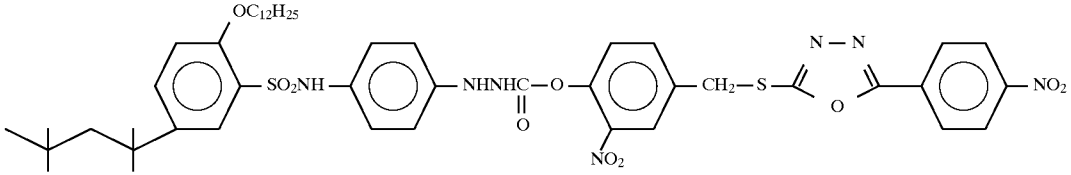
III-16
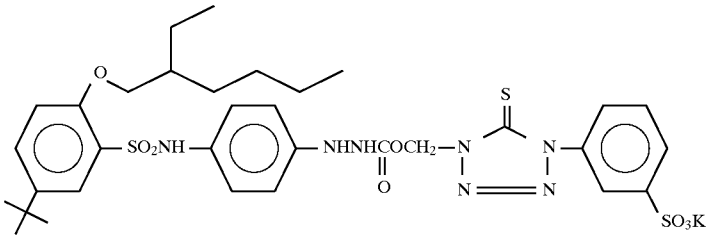
III-17
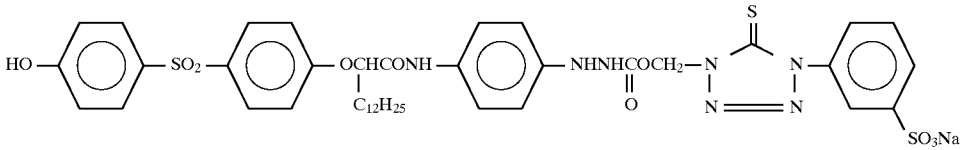
III-18
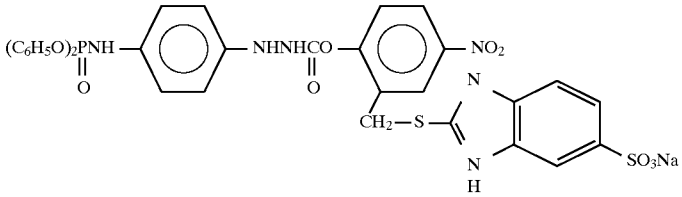

-continued
III-19
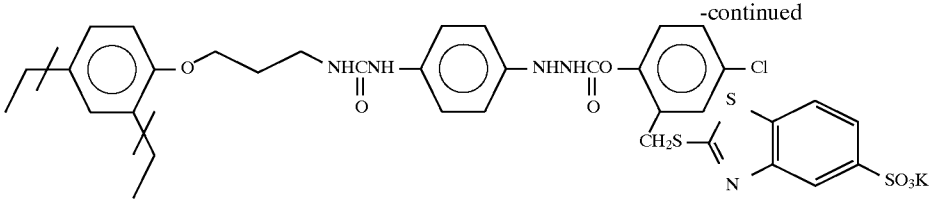
III-20
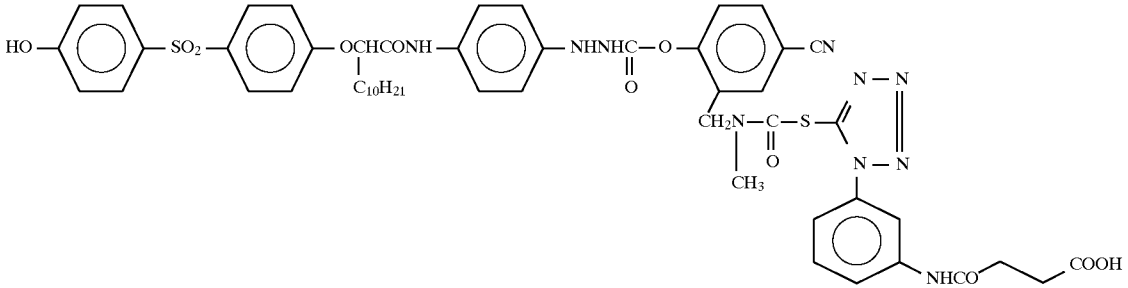
III-21
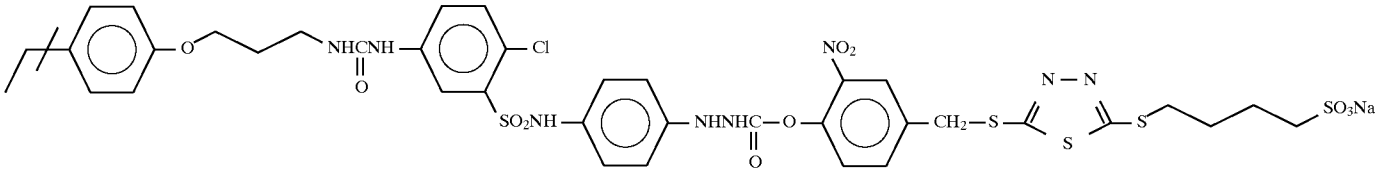
III-22
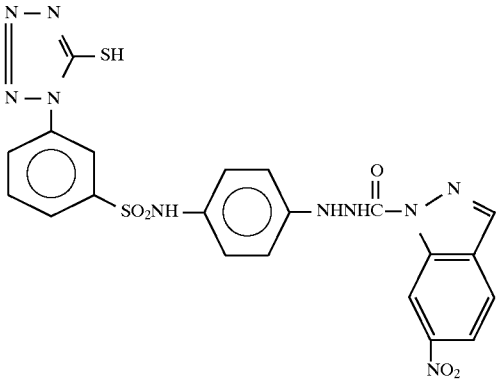

-continued
III-23
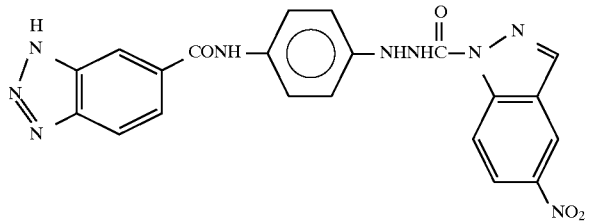
III-24
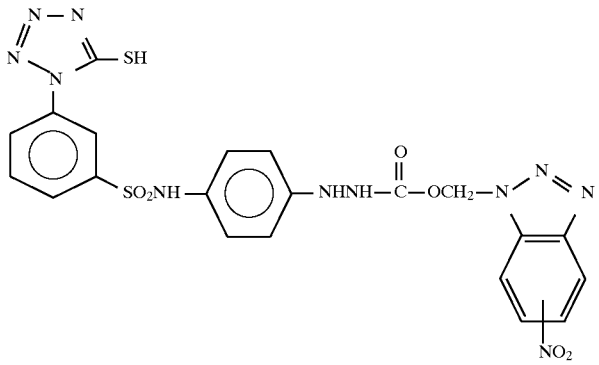
III-25
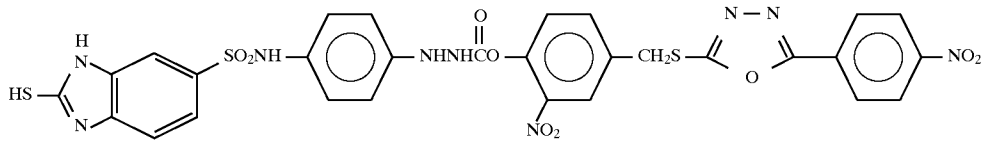
III-26
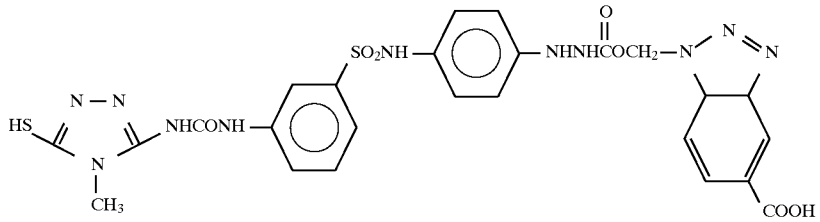

-continued
III-27
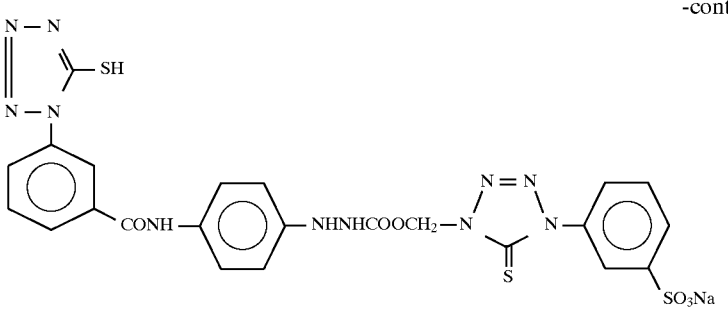
III-28
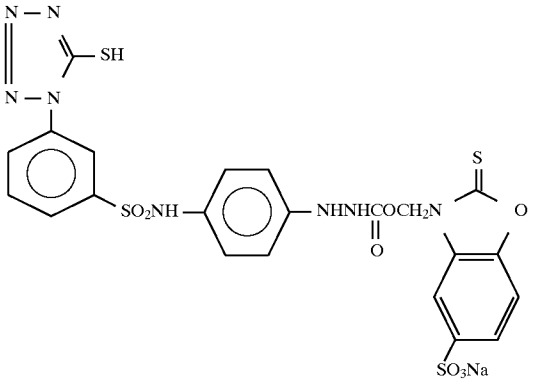
III-29
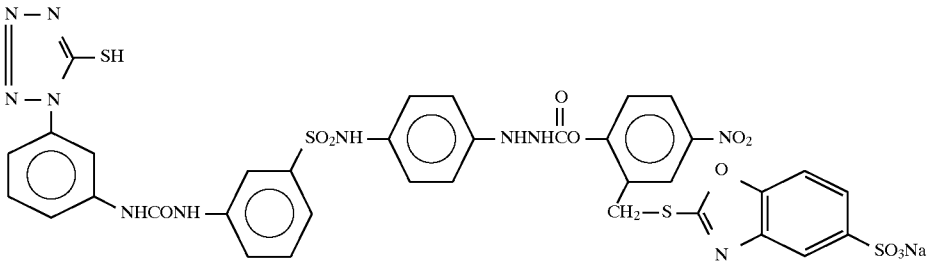

-continued
III-30
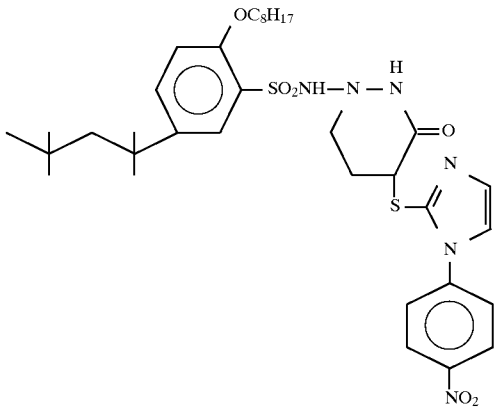
III-31
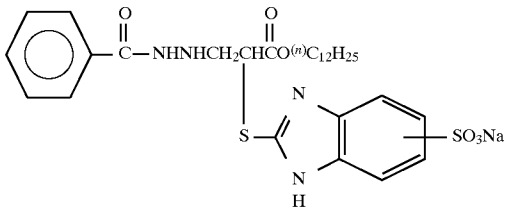
III-32
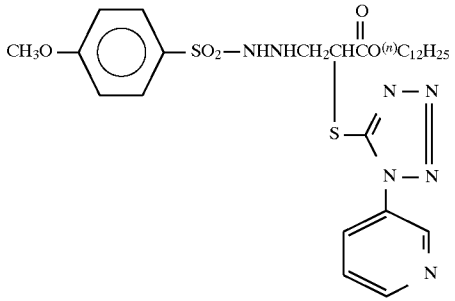

-continued
III-33
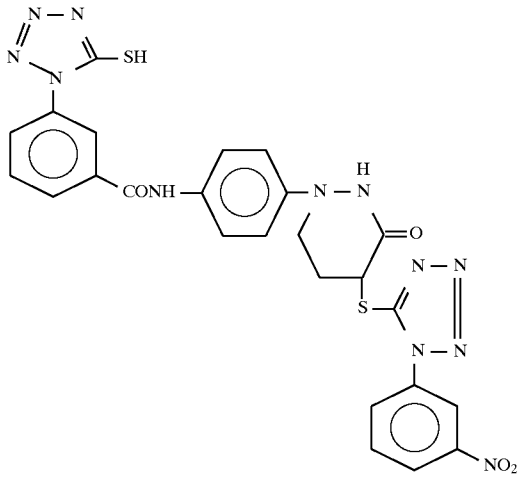
III-34
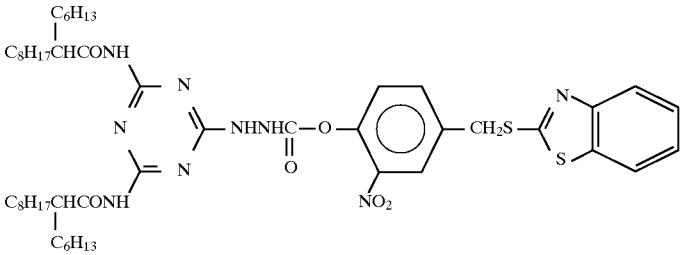
III-35
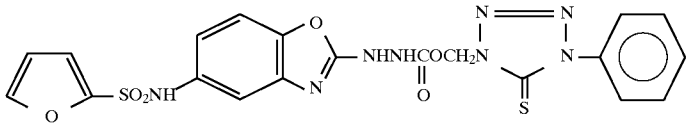
III-36
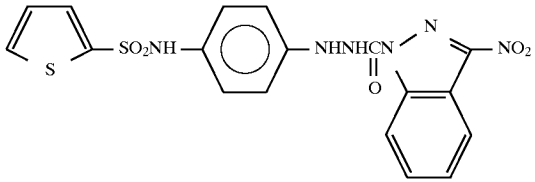

-continued
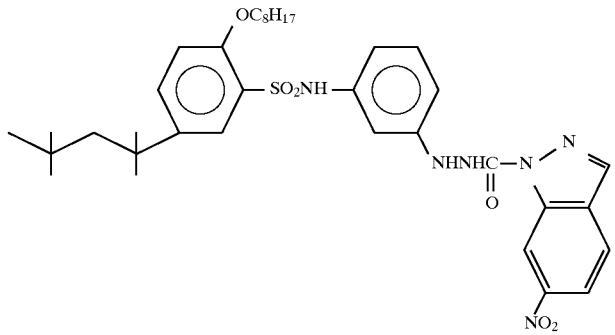
III-37
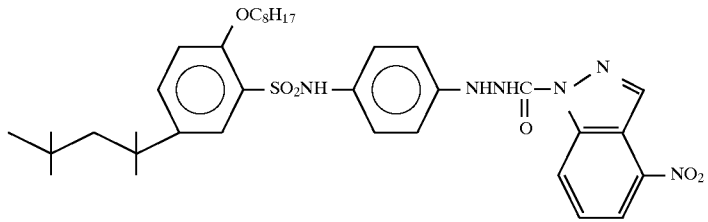
III-38
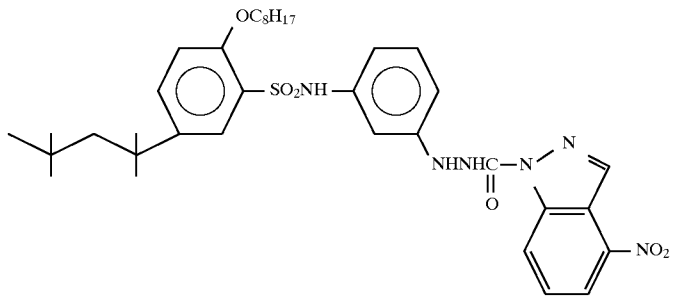
III-39

Other examples of redox compounds which can be used in the present invention include those described in JP-A-61-213847, 62-260153, and Japanese Patent Application Nos. 1-102393, 1-102394, 1-102395, and 1-114455.

Examples of the synthesis of redox compounds to be used in the present invention are described in JP-A-61-213847, 62-260153, 49-129536, 56-153336, and 56-153342, Japanese Patent Application No. 63-98803, and U.S. Pat. Nos. 4,684,604, 3,379,529, 3,620,746, 4,377,634, and 4,332,878.

The redox compound of the present invention can be used in an amount of $1\times10^{-6}$ to $5\times10^{-2}$ mol, preferably $1\times10^{-5}$ to $1\times10^{-2}$ mol per mol of silver halide in the silver halide photographic material.

The redox compound of the present invention can be used in the form of solution in a proper water-miscible organic solvent such as alcohol (e.g., methanol, ethanol, propanol, fluorinated alcohol), ketone (e.g., acetone, methyl ethyl ketone), dimethylformamide, dimethylsulfoxide, and methyl cellosolve.

A well known emulsion dispersion method can be used to dissolve the redox compound in an oil such as dibutyl phthalate, tricresyl phosphate and glyceryl triacetate or auxiliary solvent such as ethyl acetate and diethyl phthalate to mechanically prepare an emulsion dispersion. Alternatively, a method known as solid dispersion can be used to disperse redox compound grains in water by means of a ball mill or colloid mill or with an ultrasonic apparatus.

The layer containing a redox compound of the present invention may contain silver halide emulsion grains and/or hydrazine derivatives or may be one of the other hydrophilic colloidal layers.

Examples of a configuration in which a light-sensitive emulsion layer contains a hydrazine derivative and another hydrophilic colloidal layer contains a redox compound of the present invention are described in Japanese Patent Application Nos. 1-108215 and 1-240967.

The layer containing the redox compound of the present invention may be provided on or under the light-sensitive emulsion layer containing a hydrazine derivative. The layer containing the redox compound of the present invention may further contain light-sensitive or light-insensitive silver halide emulsion grains. Between the layer containing the redox compound of the present invention and the light-sensitive emulsion layer containing a hydrazine derivative may be provided an interlayer containing gelatin or a synthetic polymer (e.g., vinyl polyacetate, polyvinyl alcohol).

The halogen composition of the silver halide emulsion to be used in the present invention may be any of silver chloride, silver bromochloride, silver bromochloroiodide, silver bromide and silver bromoiodide. The silver chloride content of the silver halide emulsion is preferably 50 mol % or more, particularly 60 mol % or more. The silver halide grains may have a so-called core/shell structure in which the core thereof and the shell thereof have different halogen compositions.

The average size of silver halide grains to be contained in the silver halide emulsion of the present invention is preferably 0.7 $\mu$m or less, more preferably 0.2 $\mu$m to 0.5 $\mu$m. The grain size distribution is preferably monodisperse.

The term "monodisperse emulsion" as used herein means an "emulsion of silver halide grains having a grain size fluctuation coefficient (coefficient of variation) of 20% or less, particularly preferably 15% or less". The grain size fluctuation coefficient (%) as used herein is obtained by multiplying the quotient of the standard deviation of grain diameter by the average grain diameter by 100.

The silver halide grains of the present invention may have a regular crystal form such as a cube, tetradecahedron and octahedron, or an irregular crystal form such as sphere and tablet, or a combination of these crystal forms. Preferred among these crystal forms are regular crystal forms, and particularly preferred among these regular crystal forms is the cube.

The preparation of silver halide grains to be used in the present invention can be accomplished by any suitable method as disclosed in P. Glafkides, *Chimie et Physique Photographigue*, Paul Montel, 1967, G. F. Duffin, *Photographic Emulsion Chemistry*, The Focal Press, 1966, and V. L. Zelikman et al., *Making and Coating Photographic Emulsion*, The Focal Press, 1964.

In some detail, the emulsion can be prepared by the acid process, the neutral process, the ammonia process, etc. The reaction between a soluble silver salt and a soluble halogen salt can be carried out by a single jet process, a double jet process, a combination thereof, and the like.

A method in which grains are formed in the presence of excess silver ions, the reverse mixing method, may be used. Further, a controlled double jet process, in which the pAg value of a liquid phase in which silver halide grains are formed is maintained constant, may also be used.

According to the controlled double jet process, a silver halide emulsion having a regular crystal form and an almost uniform grain size can be obtained.

In order to provide a uniform grain size, a method which comprises changing the rate at which a silver nitrate or halogenated alkali is added depending on the growth speed of grains as disclosed in British Patent 1,535,016, and JP-B-48-36890 and 52-16364; or, a method which comprises changing the concentration of an aqueous solution as disclosed in British Patent 4,242,445, and JP-A-55-158124 may be used to allow grains to grow rapidly within the critical degree of saturation.

The formation of the silver halide emulsion of the present invention may be carried out in the presence of a silver halide solvent such as tetra-substituted thiourea and an organic thioether compound.

Preferred examples of tetra-substituted thiourea silver halide solvents which can be used in the present invention include those described in JP-A-53-82408 and 55-77737 represented by formula:

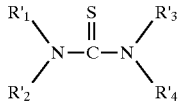

wherein $R_1'$, $R_2'$, $R_3'$ and $R_4'$ each represents a substituted or unsubstituted alkyl or alkenyl group (e.g., allyl group) or a substituted or unsubstituted aryl group and may be the same or different, the sum of the number of carbon atoms in $R_1'$ to $R_4'$ being preferably 30 or less. $R_1'$ and $R_2'$, $R_2'$ and $R_3'$, or $R_3'$ and $R_4'$ may be connected to each other to form a 5- or 6-membered heterocyclic imidazolidinethione, piperidine or morpholine. The alkyl group may be either straight-chain or branched.

Examples of substituents contained in the above mentioned substituted alkyl group include a hydroxyl group a carboxyl group, a sulfonic acid group, an amino group, an alkoxy group containing $C_{1-5}$ alkyl residue, a phenyl group, and a 5- or 6-membered heterocyclic group (e.g., furan).

Examples of substituents contained in the above mentioned substituted aryl group include a hydroxyl group, a carboxyl group, and a sulfonic acid group.

In the most preferred example, among $R_1'$ to $R_4'$, there are contained 3 or more alkyl groups. The number of carbon atoms in each of these alkyl groups is 1 to 5. The aryl group is a phenyl group. The sum of carbon atoms in $R_1'$ to $R_4'$ is 20 or less.

Examples of tetra-substituted halide solvents which can be used in the present invention include those represented by the following formulae:

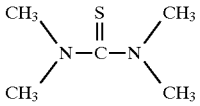
(1)

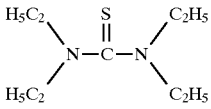
(2)

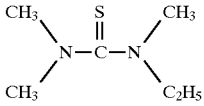
(3)

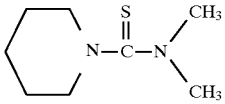
(4)

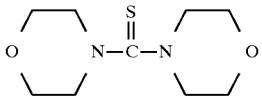
(5)

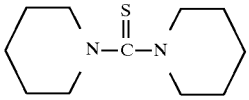
(6)

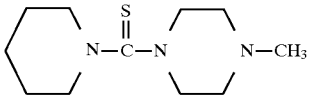
(7)

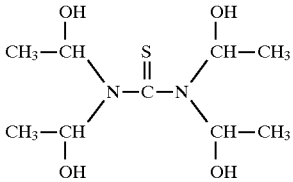
(8)

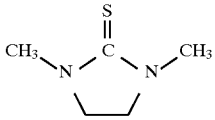
(9)

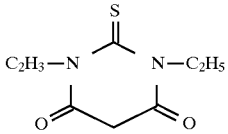
(10)

-continued

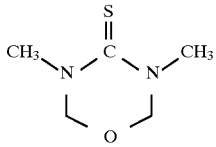
(11)

Examples of organic thioether silver halide solvents which may be preferably used in the present invention include a compound containing at least one group with an oxygen atom and a sulfur atom separated by ethylene (e.g., —O—$CH_2CH_2$—S—) as disclosed in JP-B-47-11386 (U.S. Pat. No. 3,574,628), and a chain thioether compound containing an alkyl group (this alkyl group contains at least two substituents selected from a hydroxyl group, an amino group, a carboxyl group, an amido group and a sulfonyl group) at both ends as disclosed in JP-A-54-155828 (U.S. Pat. No. 4,276,374). Specific examples of these organic thioether silver halide solvents include those represented by the following general formulae:

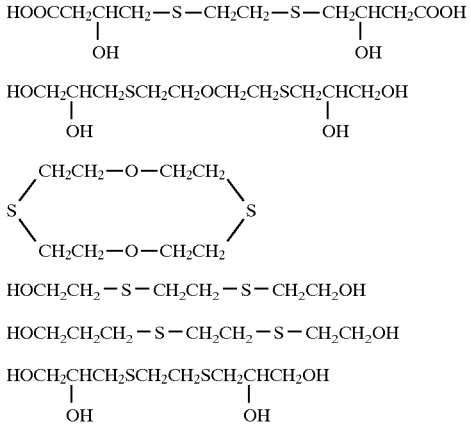

The amount of silver halide solvent incorporated in the system depends on the kind of compounds used, the desired grain size and halogen composition, and, is preferably $1\times10^{-5}$ to $1\times10^{-2}$ mol per mol of silver halide.

If the grain size exceeds the desired value due to the use of a silver halide solvent, the desired grain size can be obtained by altering the temperature at which grains are formed, the time at which a silver salt solution and a halogen salt solution are added to the system, and other factors.

The silver halide emulsion of the present invention may contain the group VIII metal atoms, particularly iridium atoms, rhodium atoms or iron atoms.

Metals of group VIII in the periodic table are iron, cobalt, nickel, ruthenium, rhodium, palladium, osmium, iridium, and platinum. Examples of compounds containing these metals which can be preferably used in the present invention include iron (II) sulfate ($FeSO_4.5H_2O$), iron (III) chloride ($FeCl_3$), potassium hexacyanoferrate (II) ($K_4Fe(CN)_6.3H_2O$), potassium hexacyanoferrate (III) ($K_3Fe(CN)_6$), cobalt (II) chloride ($CoCl_2$), cobalt (II) nitrate ($Co(NO_3)_2.6H_2O$), potassium hexacyanocobaltate (III) ($K_3CO(CN)_6$), nickel (II) chloride ($NiCl_2.6H_2O$), nickel (II) nitrate ($Ni(NO_3)_2.6H_2O$), ruthenium (III) chloride ($RuCl_3$), potassium hexachlororutheniumate (IV) ($K_2RuCl_6$), rhodium (III) chloride ($RhCl_3.4H_2O$), ammonium hexachlororhodiumate (III) ($(NH)_3RhCl_6$), palladium (II) chloride ($PdCl_2$), palladium (II) nitrate ($Pd(NO_3)_2$), palladium (II) bromide ($PdBr_2$), potassium hexachloropalladiumate (IV) ($K_2PdCl_6$), potassium tetrathiopalladiumate (II) ($K_2Pd(CNS)_4$), osmium (II) chloride ($OsCl_2$), iridium (III) chloride ($IrCl_3$), iridium (IV) chloride ($IrCl_4$), iridium (III) bromide ($IrBr_3.4H_2O$), iridium (IV) bromide ($IrBr_4$), potassium hexachloroiridiumate (III) ($K_3IrCl_6$), potassium hexachloroiridiumate (IV) ($K_2IrCl_6$), ammonium hexachloroplatinumate (IV) ($(NH_4)_2PtCl_6$), potassium hexachloroplatinumate (IV) ($K_2PtCl_6$), and ammonium hexabromoplatinumate (IV) ($(NH_4)_2PtBr_6$. These Group VIII metal compounds are each used in an amount of $1\times10^{-9}$ to $1\times10^{-3}$ mol per mol of silver halide. These compounds may be used singly or in combination. Preferred among these Group VIII metal compounds are an iridium salt, a rhodium salt and an iron salt. Two or three of these metal salts can be used in combination.

These compounds may be added to the system at each step during the preparation of a silver halide emulsion and before the coating of the silver halide emulsion. Alternatively, these compounds may be added to the system at any nucleus formation or growth step during the preparation of the silver halide grains. Furthermore, these compounds may be added to the system during the ripening of the silver halide emulsion. In particular, these compounds may preferably be added to the system during the formation of silver halide grains so that they can be incorporated in the silver halide grains.

In order to add the above mentioned metal atoms of Group VIII to the system during the formation of grains, they may be preferably incorporated in a water-soluble silver salt or water-soluble halide solution to be simultaneously added to the system. Alternatively, when a silver salt and a halide solution are simultaneously added to the system, silver halide grains may be prepared as a third solution, and all three solutions are added simultaneously. Furthermore, an aqueous solution of a salt of Group VIII metal may be charged into a reaction vessel in a required amount during or shortly after the formation of grains or during or at the end of the physical ripening of grains.

The silver halide emulsion of the present invention may be preferably subjected to gold sensitization and sulfur sensitization.

As gold sensitizer to be used in the present invention, various gold salts can be used. Examples of such gold salts include potassium chloroaurite, potassium auric thiocyanate, potassium chloroaurate, and auric trichloride.

As sulfur sensitizers to be used in the present invention, there can be used sulfur compounds contained in gelatin as well as various sulfur compounds such as thiosulfates, thioureas, thiazoles and rhodanines. Preferred among these sulfur compounds are thiosulfates and thiourea compounds.

The optimum amount of sulfur sensitizer and gold sensitizer to be incorporated is each from $1\times10^{-2}$ to $1\times10^{-7}$ mol, preferably $1\times10^{-3}$ to $1\times10^{-5}$, per mol of silver.

The molar proportion of sulfur sensitizer to gold sensitizer is from 1:3 to 3:1, preferably 1:2 to 2:1.

A cadmium salt, sulfite, lead salt, thallium salt, etc. may be present in the system during the formation or physical ripening of silver halide grains to be used in the present invention.

Alternatively, a complex of a noble metal other than gold, such as platinum, may be contained in the silver halide emulsion of the present invention.

In the present invention, a reduction sensitization process can be used.

As reduction sensitizers, stannous salts, amines, formamidinesulfinic acid, silane compounds, etc. can be used.

A thiosulfonic acid compound may be added to the silver halide emulsion by a method such as disclosed in European Patent Disclosure (EP)-293,917.

The light-sensitive material to be used in the present invention may comprise a silver halide emulsion or two or more silver halide emulsions (e.g., those having different average grain sizes, different halogen compositions, different crystal habits or different chemical sensitization conditions) in combination.

As a suitable binder or protective colloid to be incorporated in the photographic emulsion, gelatin may be used. Other hydrophilic colloids may be used as well.

The light-sensitive material to be used in the present invention may comprise a sensitizing dye (e.g., cyanine dye, melocyanine dye) as disclosed in JP-A-55-52050, p 45–53, to increase the sensitivity thereof.

These sensitizing dyes can be used singly or in combination. A combination of sensitizing dyes is often used for the purpose of supersensitization. In combination with the sensitizing dye, a dye which exhibits no spectral sensitizing effect itself, or, a substance which does not substantially absorb visible light, but exhibits a supersensitizing effect, can be incorporated in the emulsion.

Examples of useful sensitizing dyes, combinations of supersensitizing dyes and supersensitizing substances are described in *Research Disclosure* No. 17643, vol. 176, December 1978, IV-J, page 23.

The light-sensitive material of the present invention may comprise various compounds to inhibit fogging during the preparation, storage or photographic processing thereof, or to stabilize the photographic properties thereof. Preferred among these compounds are benzotriazoles (e.g., 5-methylbenzotriazole) and nitroindazoles (e.g., 5-nitroindazole). These compounds may be incorporated in the processing solution. Furthermore, a compound which releases a inhibitor during development as described in JP-A-62-30243 may be incorporated in the light-sensitive material of the present invention as a stabilizer or for the purpose of inhibiting black pepper.

The photographic light-sensitive material of the present invention may comprise developing agents such as hydroquinone derivatives and phenidone derivatives as stabilizers or accelerators, or for other various purposes.

The photographic light-sensitive material of the present invention may comprise an inorganic or organic film hardener in a photographic emulsion layer or other hydrophilic colloidal layers. For example, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogenic acids (e.g., mucochloric acid), etc. can be used alone or in combination.

The photographic emulsion layer or other hydrophilic colloidal layers in the light-sensitive material prepared according to the present invention may comprise various surface active agents to aid coating, accelerate emulsion dispersion, inhibit charging and adhesion, improve smoothness and photographic properties (e.g., acceleration of development, film hardening, sensitization), or other various purposes.

Surface active agents which may be preferably used in the present invention are polyalkylene oxides having a molecular weight of 600 or more as disclosed in JP-A-58-9412.

To inhibit charging, fluorine-containing surface active agents as disclosed in JP-A-60-80849, etc. may be preferably used.

The photographic light-sensitive material of the present invention may comprise a hydroquinone derivative which releases a development inhibitor in proportion to the density of an image (so-called DIR hydroquinone) in the photographic emulsion layer or other hydrophilic colloidal layers.

Specific examples of these DIR hydroquinones include those described in U.S. Pat. Nos. 3,379,529, 3,620,746, 4,377,634, and 4,332,878, and JP-A-49-129536, 54-67419, 56-153336, 56-153342, 59-278853, 59-90435, 59-90436, and 59-138808.

The photographic light-sensitive material of the present invention may comprise a matting agent such as silica, magnesium oxide and polymethyl methacrylate in the photographic emulsion layer or other hydrophilic colloidal layers to inhibit adhesion.

The light-sensitive material used in the present invention may comprise a water-insoluble or water-soluble synthetic polymer dispersion to stabilize dimension. For example, alkyl (meth)acrylate, alkoxyalkyl (meth)acrylate, glycidyl (meth)acrylate, etc. may be used alone or in combination. Furthermore, a polymer comprising, as a monomeric component, a combination of these acrylic acids, methacrylic acids, etc. may be used.

The silver halide emulsion layer and other layers in the photographic light-sensitive material of the present invention may contain a compound containing an acid group. Examples of such a compound containing an acid group include polymers or copolymers which contain organic acids such as salicylic acid, acetic acid and ascorbic acid or acid monomers such as acrylic acid, maleic acid and phthalic acid as repeating units.

Among these compounds, ascorbic acid is particularly preferred as a low molecular weight compound. As a high molecular weight compound a water-dispersible latex of a copolymer made of an acid monomer such as acrylic acid and a crosslinkable monomer containing two unsaturated groups such as divinylbenzene is preferred.

To provide an ultrahigh contrast and high sensitivity on the silver halide photographic material of the present invention, it is not necessary to use conventional infectious developers or a highly alkaline developer with a pH of about 13 as disclosed in U.S. Pat. No. 2,419,975. Instead, a stable developer may be used.

Thus, the silver halide photographic material of the present invention can be processed with a developer containing sulfurous ions as a preservative in an amount of 0.15 mol/l or more and having a pH of 10.5 to 12.3, particularly 11.0 to 12.0, to provide a sufficiently ultrahigh contrast negative image.

The developing agent contained in the developer used in the present invention is not specifically limited. However, the developer of the present invention preferably contains dihydroxybenzenes, which can easily provide excellent dot quality . In some cases, a combination of dihydroxybenzenes and 1-phenyl-3-pyrazolidones or a combination of dihydroxybenzenes and p-aminophenols may be used.

Examples of 1-phenyl-3-pyrazolidones or derivatives thereof which can be used as developing agents in the present invention include 1-phenyl-3-pyrazolidone, and 1-phenyl-4,4-dimethyl-4-pyrazolidone.

As a p-aminophenol developing agent used in the present invention there may be preferably used N-methyl-p-aminophenol.

Such a developing agent is preferably used in an amount of 0.05 mol/l to 0.8 mol/l. If a combination of dihydroxybenzenes and 1-phenyl-3-pyrazolidones or p-aminophenols is used, the former is preferably used in an amount of 0.05 mol/l to 0.5 mol/l, and the latter is preferably used in an amount of 0.06 mol/l or less.

Examples of sulfites which can be used as preservatives in the present invention include sodium sulfite, potassium sulfite, lithium sulfite, ammonium sulfite, sodium bisulfite, potassium metabisulfite, and sodium formaldehydebisulfite. Such a sulfite can be preferably used in an amount of 0.15 mol/l or more, particularly 0.5 mol/l or more. The upper limit of the amount of such a sulfite to be used is preferably 2.5 mol/l.

Examples of alkaline agents used for pH adjustment include pH adjustors or buffers such as sodium hydroxide, potassium hydroxide, sodium carbonate, potassium carbonate, sodium triphosphate and potassium triphosphate. The pH of the developer is set to 10.5 to 12.3.

As other additives, development inhibitors such as boric acid, borax, sodium bromide, potassium bromide and potassium iodide, organic solvents such as ethylene glycol, diethylene glycol, triethylene glycol, dimethylformamide, methyl cellosolve, hexylene glycol, ethanol and methanol, and fog inhibitors or black pepper inhibitors such as 1-phenyl-5-mercaptotetrazole, indazole compounds (e.g., 5-nitroindazole), and benztriazole compounds (e.g., 5-methylbenztriazole) may be used. In addition, color toners, surface active agents, antifoaming agents, water softeners, film hardeners, and amino compounds, as disclosed in JP-A-56-106244 and Japanese Patent Application No. 1-29418, may be used.

The developer used in the practice of the present invention may comprise a compound disclosed in JP-A-56-24347 as a silver stain inhibitor. As a dissolution aid contained in the developer, a compound as disclosed in JP-A-61-267759 may be used. Furthermore, as a pH buffer to be contained in the developer there can be used a compound as disclosed in JP-A-60-93433 or a compound as disclosed in JP-A-62-186259.

Any common fixing agent can be used. As such fixing agents, thiosulfate and thiocyanate, as well as organic sulfur compounds which have been known to serve as fixing agents may be used. The fixing bath may contain a water-soluble aluminum salt (e.g., aluminum sulfate, alum) as a film hardener. The amount of such a water-soluble aluminum salt to be used is normally in the range of 0.4 to 2.0 g-Al/l. Furthermore, a trivalent iron compound can be used as an oxidizing agent in the form of complex with ethylenediaminetetraacetic acid.

The development temperature is normally selected between 18° C. and 50° C., preferably between 25° C. and 43° C.

The silver halide photographic material of the present invention can provide a high Dmax value. Therefore, when subjected to reduction, the silver halide photographic material can maintain a high density even if the dot area is decreased.

The present invention will be further described in the following examples, but the present invention should not be construed as being limited thereto.

EXAMPLE 1

Emulsion A was prepared in accordance with the method described below.

Emulsion A

An aqueous solution of 0.37 mole of silver nitrate and an aqueous solution of halogen salts containing $(NH_4)_3RhCl_6$ in an amount of $1\times10^{-7}$ mole per mole of silver, $K_3IrCl_6$ in an amount of $2\times10^{-7}$ mole per mole of silver, potassium bromide in an amount of 0.11 mole per mole of silver and sodium chloride in an amount of 0.27 mole per mole of silver were added to an aqueous solution of gelatin containing sodium chloride and 1,3-dimethyl-2-imidazolidinethione with stirring at a temperature of 45° C. in 12 minutes in a double jet process to prepare silver bromochloride grains having an average grain size of 0.20 μm and a silver chloride content of 70 mol %. Thus, nuclei were formed.

Then, an aqueous solution of 0.63 mole of silver nitrate and an aqueous solution of halogen salts containing 0.19 mole of potassium bromide and 0.47 mole of sodium chloride were similarly added to the system in 20 minutes in a double jet process. The system was then washed with water by an ordinary flocculation method. 40 g of gelatin was added to the system. The system was then adjusted to a pH of 6.5 and a pAg of 7.5.

Sodium benzenethiosulfonate, sodium thiosulfate and chloroauric acid were then added to the system in amounts of 7 mg, 5 mg and 8 mg per mole of silver, respectively. The system was heated to a temperature of 60° C. for 45 minutes so that it was chemically sensitized. 150 mg of 4-hydroxy-6-methyl-1,3,3a,7-tetrazaindene as a stabilizer and Proxel as an antiseptic were added to the system. A solution of potassium iodide in an amount of $1\times10^{-3}$ mole per mole of silver was added to the system which was then allowed to stand for 10 minutes. As a result, an emulsion of cubic silver bromochloride grains having an average size of 0.28 μm and a silver chloride content of 70 mol % was obtained (fluctuation coefficient: 9%).

To the emulsion thus obtained were added a potassium salt of 5-[3-(4-sulfobutyl)-5-chloro-2-oxazolidylidene]-1-hydroxyethyl-3-(2-pyridyl)-2-thiohydantoinin an amount of $1\times10^{-3}$ mole per mole of silver, a short wave cyanine dye having the following structural formula (a) in an amount of $5\times10^{-4}$ mole per mole of silver, a mercapto compound having the following structural formula (b) in an amount of $2\times10^{-4}$ mole per mole of silver, and a compound of formula (I) and a hydrazine derivative of formula (II) as set forth in Table 1.

TABLE 1

| Coating solution | Compound of the general formula (I) | | Hydrazine compound | |
|---|---|---|---|---|
| No. | Type | Added amount* | Type | Added amount* |
| 1 | I-4 | $5\times10^{-4}$ | — | — |
| 2 | I-13 | $5\times10^{-4}$ | — | — |
| 3 | — | — | II-7 | $6\times10^{-4}$ |
| 4 | I-4 | $2\times10^{-4}$ | " | " |
| 5 | I-4 | $5\times10^{-4}$ | " | " |
| 6 | I-13 | $2\times10^{-4}$ | " | " |
| 7 | I-13 | $5\times10^{-4}$ | " | " |

*mole/mole of silver

Structural formula (a):

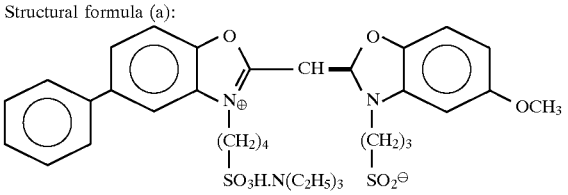

Structural formula (b):

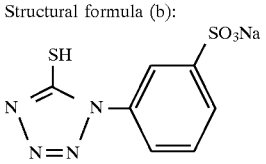

These emulsions were each allowed to stand at a temperature of 40° C. for 1 hour and for 4 hours. Thus, fresh solutions and aged solutions were obtained. To each of these solutions were added 400 mg/m$^2$ of a polyethyl acrylate dispersion and 100 mg/m$^2$ of 1,3-divinylsulfonyl-2-propanol as a film hardener. These coating solutions were each then coated on a polyethylene terephthalate film in such an amount that the coated amount of silver reached 3.6 g/m$^2$.

On the material thus obtained were simultaneously coated a protective layer containing 1.2 g/m$^2$ of gelatin, 40 mg/m$^2$ of amorphous $SiO_2$ grains having a size of about 3 μm as a matting agent, 0.1 g/m$^2$ of methanol silica, 100 mg/m$^2$ of polyacrylamide, 200 mg/m$^2$ of hydroquinone, a silicone oil, Proxel and phenoxyethanol as antiseptics, and a fluorine surface active agent represented by the following structural formula (c) and sodium dodecylbenzensulfonate as coating aids, whereby specimens as set forth in Table 3 were prepared.

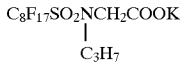

Structural formula (c)

The back layer had the following formulation:

| | |
|---|---|
| Gelatin | 4 g/m$^2$ |
| Matting agent (polymethyl methacrylate: grain diameter: 3.0 to 4.0 μm) | 10 mg/m$^2$ |
| Latex (polyethyl acrylate) | 2 g/m$^2$ |
| Surface active agent (sodium p-dodecylbenzenesulfonate) | 40 mg/m$^2$ |
| Fluorine surface active agent (compound having the structural formula (c) used in the protective layer) | 5 mg/m$^2$ |
| Gelatin hardener (compound having the structural formula (d)) | 110 mg/m$^2$ |

Structural formula (d)

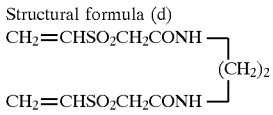

Dye (mixture of dyes having the following structural formulae (a), (b) and (c))

Dye (a)

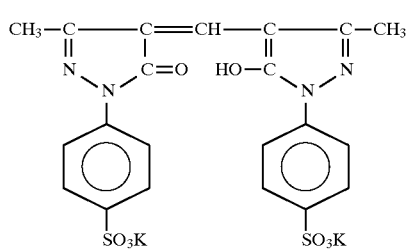

Dye (b)

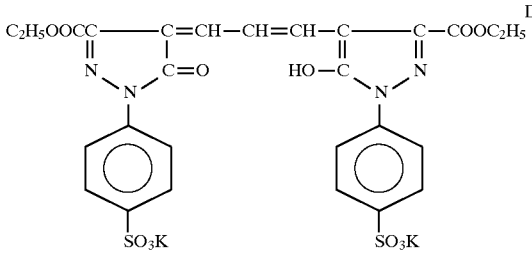

-continued

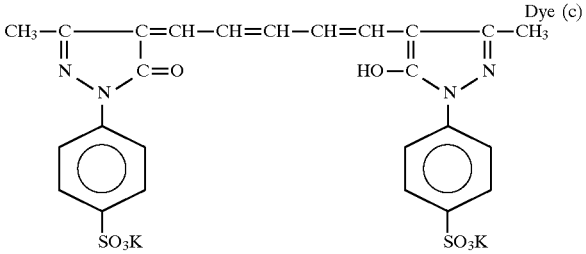

The back layer coating solution comprised Proxel and phenoxy ethanol as antiseptics.

The specimens thus prepared were exposed to light from a tungsten lamp through a step wedge, developed with a developer as set forth in Table 2 and GR-F1 produced by Fuji Photo Film Co. , Ltd. by means of an automatic developing machine FG-710F produced by Fuji Photo Film Co., Ltd. at a temperature of 34° C. for 30 seconds, and then evaluated for sensitivity and γ.

The sensitivity is represented by the common logarithm of the reciprocal of the exposure at which development at 34° C. for 30 seconds gives a density of (fog+0.1) relative to the value of Specimen 1-1 as 1. The higher this value is, the higher the sensitivity. The value of γ is represented by γ in the portion of from D (density)=0.3 and D=3.0 given by development at a temperature of 34° C. for 30 seconds.

Further, using the specimens prepared with a fresh solution (i.e., ageing time: 0 hour), a storage stability test was conducted in the following manner. The specimens stored at 25° C. and 55% RH for 7 days (condition 1), and the specimens stored at 25° C. and 40% RH for 2 hours which was then subjected to a heat-seal treatment under the same condition and allowed to stand at 40° C. for 20 days (condition 2) were measured with respect to sensitivity. The storage stability was evaluated in terms of the change in sensitivity ΔlogE, which is the difference subtracting the common logarithm of the reciprocal of the exposure giving the density of 1.5 by the development of the condition-1 specimen at 34° C. for 30 seconds from that of the condition-2 specimen. The larger ΔlogE means less storage stability.

TABLE 2

| | |
|---|---|
| Hydroquinone | 50.0 g |
| N-methyl-p-aminophenol | 0.3 g |
| Sodium hydroxide | 18.0 g |
| 5-Sulfosalicylic acid | 30.0 g |
| Boric acid | 20.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| N-n-butyldiethanolamine | 15.0 g |
| Sodium toluenesulfonate | 4.0 g |
| Water to make | 1 l |
| pH (adjusted with potassium hydroxide) | 11.7 |

The results are set forth in Table 3.

Specimens 1-1 to 1-6 free of hydrazine derivative exhibit a low γ value and thus cannot provide an ultrahigh contrast image required for plate-making light-sensitive material. Specimens 1-7 to 1-9 free of the compound of formula (I) of the present invention exhibit a great increase in the sensitivity due to the ageing of coating solution and thus were not prepared with a stable qualities.

Specimens 1-10 to 1-21 of the present invention can provide high sensitivity and contrast image and can be prepared with stable qualities. Further, these specimens of the present invention have less change in sensitivity (ΔlogE), as compared to the above comparative specimens, exhibiting better storage stability.

TABLE 3

| Specimen No. | Coating No. | Ageing time | Sensitivity | Sensitivity increase with time* | χ | ΔlogE |
|---|---|---|---|---|---|---|
| 1-1 | 1 | 0 | 1.00 | | 5.5 | 0.04 |
| 1-2 | " | 1 | 1.01 | | 5.3 | |
| 1-3 | " | 4 | 1.04 | 0.04 | 5.4 | |
| 1-4 | 2 | 0 | 1.00 | | 5.4 | 0.04 |
| 1-5 | " | 1 | 1.01 | | 5.4 | |
| 1-6 | " | 4 | 1.05 | 0.05 | 5.3 | |
| 1-7 | 3 | 0 | 1.10 | | 13.0 | 0.15 |
| 1-8 | " | 1 | 1.13 | | 12.5 | |
| 1-9 | " | 4 | 1.21 | 0.11 | 12.5 | |
| 1-10 | 4 | 0 | 1.10 | | 13.0 | 0.05 |
| 1-11 | " | 1 | 1.12 | | 12.8 | |
| 1-12 | " | 4 | 1.15 | 0.05 | 12.8 | |
| 1-13 | 5 | 0 | 1.08 | | 13.0 | 0.04 |
| 1-14 | " | 1 | 1.09 | | 13.0 | |
| 1-15 | " | 4 | 1.12 | 0.04 | 12.8 | |
| 1-16 | 6 | 0 | 1.08 | | 13.0 | 0.06 |
| 1-17 | " | 1 | 1.09 | | 12.8 | |
| 1-18 | " | 4 | 1.13 | 0.05 | 12.6 | |
| 1-19 | 7 | 0 | 1.06 | | 12.8 | 0.05 |
| 1-20 | " | 1 | 1.07 | | 12.6 | |
| 1-21 | " | 4 | 1.10 | 0.04 | 12.6 | |

(Specimens 1-1 to 1-9 are comparative while the rest of the specimens are according to the present invention)
*Value obtained by subtracting sensitivity developed without ageing from sensitivity developed after 4 hour ageing of coating solution

EXAMPLE 2

Emulsions B and C were prepared as follows

An aqueous solution of 0.37 mole of silver nitrate and an aqueous solution of halogen salts containing $(NH_4)_3RhCl_6$ in an amount of $1\times10^{-7}$ mole per mole of silver, $K_3IrCl_6$ in an amount of $2\times10^{-7}$ mole per mole of silver, potassium bromide in an amount of 0.19 mole per mole of silver and sodium chloride in an amount of 0.19 mole per mole of silver were added to an aqueous solution of gelatin containing sodium chloride and 1,3-dimethyl-2-imidazolidinethione with stirring at a temperature of 40° C. in 12 minutes in a double jet process to prepare silver bromochloride grains having an average grain size of 0.20 μm and a silver chloride content of 50 mol %. Thus, nuclei were formed.

Then, an aqueous solution of 0.63 mole of silver nitrate and an aqueous solution of halogen salts containing 0.32 mole of potassium bromide and 0.34 mole of sodium chloride were similarly added to the system in 20 minutes in a double jet process. The system was then washed with water and subjected to chemical sensitization, etc. in the same manner as Emulsion A to prepare an emulsion of cubic silver halide grains having an average size of 0.28 μm and a silver chloride content of 50 mol % (fluctuation coefficient: 9%) (Emulsion B).

To Emulsion B thus obtained was added sensitizing dyes were added, etc. in the same manner as Emulsion A in Example 1. To the emulsion was further added a hydrazine compound (II-7) of the present invention in an amount of $4\times10^{-4}$ mole per mole of silver. To the emulsion was further added Compound (I-4) of the present invention in an amount of $5\times10^{-4}$ mole per mole of silver to thereby obtain Emulsion C. Emulsion C was then aged at a temperature of 40°

C. to obtain an aged solution. The aged solution was then coated on a support along with a protective layer and a back layer in the same manner as in Example 1. The specimen thus obtained was then evaluated in the same manner as in Example 1. As in Example 1, specimens having a configuration comprising the present compound (I) and a hydrazine derivative exhibited excellent properties.

EXAMPLE 3

Emulsion for hydrazine-containing layer

As an emulsion for a hydrazine-containing layer, Emulsion A of Example 1 was used. A sensitizing dye was added to the system in the same manner as in Example 1. A hydrazine derivative (II-7) of the present invention was added to the system in an amount of $5\times10^{-5}$ mole/m$^2$. A compound of the present invention represented by the general formula (I) was then added to the system as set forth in Table 4. The system was aged at a temperature of 40° C. to obtain an aged solution. To the aged solution were added a polyethyl acrylate dispersion and a film hardener in the same manner as in Example 1.

Preparation of emulsion for redox compound-containing layer

An aqueous solution of 1.0 mole of silver nitrate and an aqueous solution of halogen salts containing $(NH_4)_3RhCl_6$ in an amount of $3\times10^{-7}$ mole per mole of silver, potassium bromide in an amount of 0.3 mole per mole of silver and sodium chloride in an amount of 0.74 mole per mole of silver were added to an aqueous solution of gelatin containing sodium chloride and 1,3-dimethyl-2-imidazolidinethione with stirring at a temperature of 45° C. in 30 minutes in a double jet process to prepare silver bromochloride grains having an average grain size of 0.28 Mm and a silver chloride content of 70 mol %. The system was then washed with water by an ordinary flocculation method. 40 g of gelatin was added to the system. The system was then adjusted to a pH of 6.5 and a pAg 7.5. Sodium thiosulfate and chloroauric acid were then added to the system in amounts of 5 mg and 8 mg per mole of silver, respectively. The system was heated to a temperature of 60° C. for 60 minutes so that it was chemically sensitized. 150 mg of 4-hydroxy-6-methyl-1,3,3a,7-tetrazaindene was added to the system as a stabilizer. As a result, an emulsion of cubic silver bromochloride grains having an average size of 0.28 $\mu$m and a silver chloride content of 70 mol % was obtained (fluctuation coefficient: 10%).

The emulsion was divided into several batches. To each of these batches was added a potassium salt of 5-[3-(4-sulfobutyl)-5-chloro-2-oxazolidilidene]-1-hydroxyethyl-3-(2-pyridyl)-2-thiohydantoin in an amount of $1\times10^{-3}$ mole per mole of silver, 1-phenyl-5-mercaptotetrazole in an amount of $2\times10^{-4}$, a polyethyl acrylate dispersion in an amount of 50 mg/m$^2$, 1,2-bis(vinylsulfonylacetamido) ethane in an amount of 40 mg/m$^2$, and a redox compound of the present invention as set forth in Table 4.

The emulsion for the redox compound-containing layer thus obtained was then coated on a polyethylene terephthalate film, with a gelatin layer (gelatin content: 0.3 g/m$^2$) as a lowermost layer, a hydrazine-containing layer (coated amount of silver: 3.6 g/m$^2$; gelatin content: 2 g/m$^2$) and an interlayer (gelatin content: 1 g/m$^2$) interposed therebetween, in such an amount that the coated amount of silver and gelatin in the redox compound-containing layer reached 0.4 g/m$^2$ and 0.5 g/m$^2$, respectively.

On the material thus obtained was simultaneously coated a protective layer containing 0.5 g/m$^2$ of gelatin, 40 mg/m$^2$ of amorphous $SiO_2$ grains having a size of about 3 $\mu$m as a matting agent, 0.1 g/m$^2$ of methanol silica, 100 mg/m$^2$ of polyacrylamide, 200 mg/m$^2$ of hydroquinone, a silicone oil, Proxel and phenoxyethanol as antiseptics, and a fluorine surface active agent represented by the structural formula (c) and sodium dodecylbenzensulfonate as used in Example 1 as coating aids, whereby specimens as set forth in Table 4 were prepared.

The back layer was coated in the same manner as Example 1.

The specimens thus obtained were then evaluated in accordance with the following test methods:

Test methods

1. Evaluation of enlarged image quality (1) Preparation of original

Using a monochromatic scanner SCANART30 and a light-sensitive material SF-100 dedicated for this purpose (produced by Fuji Photo Film Co., Ltd.), a transparent image of a person made of dots and a step wedge having a stepwise gradation of dot percentage were prepared. The number of lines in the screen was 150 per inch.

(2) Picture taking

These originals were positioned in a plate-making camera C-440 produced by Dainippon Screen Mfg. Co., Ltd. in such a manner that the magnification of enlargement was uniform. The specimens to be evaluated were each then exposed to light from a xenon lamp in such a manner that the portion of 95 dot percentage on the original turned to 5 dot percentage on the light-sensitive material.

(3) Evaluation

A five step evaluation (5 (excellent) to 1 (poor)) was made on the gradation reproducibility (difficulty in dot collapse) of the shadow portion of the specimen on the small dot side (highlighted portion) at which the dot percentage was adjusted by controlling the exposure as described in the above.

2. Evaluation of Copy Dot (1) Preparation of original

Using a monochromatic scanner SCANART30 and a light-sensitive material SF-100WP dedicated for this purpose (produced by Fuji Photo Film Co., Ltd.), a step wedge having a stepwise gradation of dot percentage was prepared. The number of lines in the screen upon exposure was 150 per inch.

(2) Picture taking

The original and the specimen were properly positioned in a plate-making camera C-690 (Autocompanica) produced by Dainippon Screen Mfg. Co., Ltd. The specimen was then exposed to light emitted by a xenon lamp and reflected from the original.

The exposure time was adjusted such that the 80% step wedge portion on the original turned to 10% step wedge on the specimen.

(3) Evaluation

A five step evaluation (excellent: 5; 1: poor) was made on the gradation reproducibility (difficulty in dot collapse) of the shadow portion of the specimen on the small dot side (highlighted portion) at which the dot percentage was adjusted by controlling the exposure time as described in the above.

The specimens thus obtained were exposed to light from a xenon lamp, processed with a developer as set forth in Example 1 and fixing solution GR-F1 produced by Fuji Photo Film Co., Ltd. at a temperature of 34° C. for 30 seconds by means of an automatic developing machine FG-710F, and then evaluated for enlarged image quality and copy dot quality.

The sensitivity is represented by the common logarithm of the reciprocal of the exposure at which development at 34°

C. for 30 seconds gives a density of (fog+0.1) with the value of Specimen 2-1 as 1. The greater this value, the higher the sensitivity.

Dmax is represented by the density corresponding to the practical Dmax value (density at the exposure of (log E for density of 0.1)+0.5 on the characteristic curve).

The value of γ is represented by γ in the portion between D (density)=0.3 and D=3.0 given by development at 34° C. for 30 seconds.

The storage stability was also measured in the same manner as in Example 1.

The results are set forth in Table 4.

The specimens free o f compound of the present invention represented by formula (I) exhibit a great sensitivity rise due to ageing after dissolution and thus are not suitable for stable preparation. Further, they have a large ΔlogE and exhibit increase in sensitivity after long storage.

The specimens comprising the compounds of formula (I) and the redox compound of the present invention can be stably prepared and exhibit remarkable improvements in copy dot quality, enlarged image quality and storage stability.

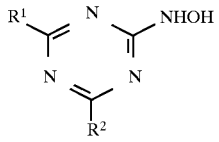

(I)

wherein $R^1$ and $R^2$ may be the same or different and each represents a hydroxyl, hydroxylamino, amino, alkylamino, arylamino, aralkylamino, alkoxy, phenoxy, alkyl, aryl, alkylthio, or phenylthio group,

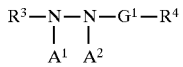

(II)

wherein $R^3$ represents an aliphatic or aromatic group; $R^4$ represents a hydrogen atom, or an alkyl, aryl, alkoxy, aryloxy, amino or hydrazino group; $G^1$ represents a —CO—, —$SO_2$—, —SO—, —P(O)$R^4$—, —CO—CO—, thiocarbonyl or iminomethylene group; and $A^1$ and $A^2$ each represents a hydrogen atom, or one of $A^1$ and $A^2$ represents a hydrogen atom and the other represents a substituted or unsubstituted alkylsulfonyl, arylsulfonyl or acyl group.

TABLE 4

| Specimen | Compound (I) | | Redox Compond | | Photographic Properties | | | | | Copy dot | Enlarged |
|---|---|---|---|---|---|---|---|---|---|---|---|
| | | | | | | Sensitivity rise with | | | | | |
| No. | Kind | Added Amount* | Type | Added Amount** | Sensitivity | time*** | χ | Dmax | ΔlogE | Quality | Quality |
| 2-1 | " | " | III-9 | $1.3 \times 10^{-4}$ | 1.00 | 0.11 | 11.0 | 5.4 | 0.13 | 5 | 4 |
| 2-2 | " | " | III-38 | " | 0.98 | 0.10 | 10.5 | 5.3 | 0.14 | 5 | 4 |
| 2-3 | " | " | III-39 | " | 1.00 | 0.11 | 10.5 | 5.3 | 0.14 | 5 | 4 |
| 2-4 | I-4 | $5 \times 10^{-4}$ | — | — | 1.05 | 0.04 | 12.0 | 5.5 | 0.05 | 3 | 3 |
| 2-5 | " | " | III-9 | $1.3 \times 10^{-4}$ | 1.00 | 0.04 | 11.0 | 5.3 | 0.05 | 5 | 4 |
| 2-6 | " | " | III-38 | " | 1.00 | 0.04 | 11.0 | 5.3 | 0.05 | 5 | 4 |
| 2-7 | " | " | III-39 | " | 1.02 | 0.04 | 11.0 | 5.3 | 0.05 | 5 | 4 |
| 2-8 | I-13 | $2 \times 10^{-4}$ | — | — | 1.05 | 0.04 | 12.0 | 5.5 | 0.05 | 3 | 2 |
| 2-9 | " | " | III-9 | $1.3 \times 10^{-4}$ | 0.98 | 0.04 | 11.5 | 5.3 | 0.04 | 5 | 4 |
| 2-10 | " | " | III-38 | " | 0.98 | 0.05 | 11.0 | 5.3 | 0.05 | 5 | 5 |
| 2-11 | " | " | III-39 | " | 0.98 | 0.05 | 11.0 | 5.3 | 0.05 | 5 | 4 |

*mole/mole of silver
**mole/$m^2$
***Value obtained by subtracting sensitivity developed without ageing from sensitivity developed after 4 hour ageing of coating solution While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, wherein the silver halide emulsion in said silver halide emulsion layer comprises a silver halide having a silver chloride content of not less than 50 mol % based on the total silver halide content of said silver halide emulsion and is chemically sensitized, and wherein said silver halide emulsion layer contains a compound represented by formula (I), and said silver halide emulsion layer or another hydrophilic colloidal layer contains a hydrazine derivative represented by formula (II):

2. The silver halide photographic material as claimed in claim 1, which further comprises, in said silver halide emulsion layer or another hydrophilic colloidal layer, a redox compound which undergoes oxidation to release a development inhibitor.

3. A silver halide photographic material as claimed in claim 1, wherein said compound of formula (I) is incorporated into the silver halide emulsion layer in an amount of 0.1 to 1.0 g per mole of silver.

4. A silver halide photographic material as claimed in claim 1, wherein $R^3$ in formula (II) is an aryl group containing benzene rings.

5. A silver halide photographic material as claimed in claim 1, wherein $G^1$ in formula (II) is a —CO— group.

6. A silver halide photographic material as claimed in claim 1, wherein one of $R^3$ and $R^4$ in formula (II) contain a ballast group.

7. A silver halide photographic material as claimed in claim 1, wherein the amount of said hydrazine derivative of formula (II) is $1\times10^{-5}$ to $2\times10^{-2}$ mole per mole of silver halide.

8. A silver halide photographic material as claimed in claim 1, wherein the silver chloride content of the silver halide emulsion is greater than 60 mol %.

9. A silver halide photographic material as claimed in claim 2, wherein the amount of the redox compound incorporated into the silver halide photographic material is $1\times10^{-5}$ to $1\times10^{-2}$ mole per mole of silver halide.

10. A silver halide photographic material as claimed in claim 1, wherein said compound represented by formula (I) is incorporated into said light sensitive silver halide emulsion layer.

* * * * *